US008216007B2

(12) United States Patent
Moore

(10) Patent No.: US 8,216,007 B2
(45) Date of Patent: Jul. 10, 2012

(54) METHODS AND ARRANGEMENTS FOR RAPID TRIM ADJUSTMENT

(76) Inventor: Steven Clay Moore, Austin, TX (US)

( * ) Notice: Subject to any disclaimer, the term of this patent is extended or adjusted under 35 U.S.C. 154(b) by 752 days.

(21) Appl. No.: 11/362,990

(22) Filed: Feb. 27, 2006

(65) Prior Publication Data

US 2007/0202757 A1 Aug. 30, 2007

(51) Int. Cl.

| | |
|---|---|
| ***B63B 1/22*** | (2006.01) |
| ***B63B 39/06*** | (2006.01) |
| ***B63H 5/125*** | (2006.01) |
| ***B63H 20/08*** | (2006.01) |
| ***B63H 20/12*** | (2006.01) |
| ***B63H 21/26*** | (2006.01) |

(52) U.S. Cl. ..... 440/1; 440/53; 440/61 T; 114/285

(58) Field of Classification Search ..... 114/284–286; 440/1, 53, 61 R, 61 T–61 J; 701/21
See application file for complete search history.

(56) References Cited

U.S. PATENT DOCUMENTS

| | | | | | |
|---|---|---|---|---|---|
| 3,391,667 | A | | 7/1968 | Lo Bue | |
| 3,399,643 | A | | 9/1968 | Bennett | |
| 3,568,618 | A | | 3/1971 | Bedford, Jr. | |
| 3,577,948 | A | | 5/1971 | Frey | |
| 3,601,078 | A | | 8/1971 | Bedford, Jr. | |
| 3,626,893 | A | * | 12/1971 | Zurakowski | 440/113 |
| 3,628,484 | A | | 12/1971 | Banner | |
| 3,628,487 | A | * | 12/1971 | Bennett | 114/287 |
| 3,695,204 | A | | 10/1972 | Bennett | |
| 3,760,758 | A | | 9/1973 | Banner | |
| 3,949,700 | A | | 4/1976 | Baroody | |
| 3,980,035 | A | | 9/1976 | Johansson | |
| 4,086,869 | A | | 5/1978 | Woodruff | |
| 4,261,278 | A | | 4/1981 | Gaudin | |
| 4,718,872 | A | | 1/1988 | Olson et al. | |
| 4,742,794 | A | * | 5/1988 | Hagstrom | 114/286 |
| 4,749,926 | A | | 6/1988 | Ontolchik | |
| 4,854,259 | A | | 8/1989 | Cluett | |
| 4,896,622 | A | | 1/1990 | Thomas | |
| 4,961,396 | A | | 10/1990 | Sasagawa | |
| 4,967,682 | A | | 11/1990 | O'Donnell | |
| 5,113,780 | A | | 5/1992 | Bennett et al. | |
| 5,118,315 | A | * | 6/1992 | Funami et al. | 440/1 |
| 5,167,546 | A | | 12/1992 | Whipple | |
| 5,169,348 | A | * | 12/1992 | Ogiwara et al. | 440/1 |
| 5,171,172 | A | | 12/1992 | Heaton et al. | |
| 5,217,399 | A | * | 6/1993 | Strang | 440/61 R |
| 5,263,432 | A | | 11/1993 | Davis | |
| 5,315,951 | A | | 5/1994 | Finkl | |
| 5,366,393 | A | * | 11/1994 | Uenage et al. | 440/1 |
| 5,385,110 | A | | 1/1995 | Bennett et al. | |
| 5,474,012 | A | | 12/1995 | Yamada et al. | |
| 5,540,174 | A | | 7/1996 | Kishi et al. | |

(Continued)

*Primary Examiner* — Ajay Vasudeva
(74) *Attorney, Agent, or Firm* — Schubert Law Group PLLC

(57) ABSTRACT

Methods and arrangements to rapidly adjust the trim of a watercraft are disclosed. More specifically, embodiments comprise a sensor to quickly detect changes in the trim angle of a watercraft and a driver adapted to effect rapid changes in the trim angle. For example, many embodiments include large hydraulic pumps and hydraulic connections to adjust the angle of a trim adjuster such as the angle of trim tabs, an outboard motor, or a stern drive. Some embodiments implement high torque electric motors or high capacity pneumatic systems. The drivers may, for example, effect changes in the angle of the trim adjuster within two seconds. In one embodiment, the driver may effect a change in the trim angle within one second or less.

13 Claims, 14 Drawing Sheets

U.S. PATENT DOCUMENTS

| | | | | |
|---|---|---|---|---|
| 5,549,071 | A | 8/1996 | Pigeon et al. | |
| 5,645,009 | A | 7/1997 | Lexau | |
| 5,683,275 | A | 11/1997 | Nanami | |
| 5,785,562 | A | 7/1998 | Nestvall | |
| 5,787,835 | A | 8/1998 | Remnant | |
| 5,860,384 | A | 1/1999 | Castillo | |
| 5,879,209 | A | 3/1999 | Jones | |
| 6,006,689 | A | 12/1999 | Olofsson | |
| 6,012,408 | A | 1/2000 | Castillo | |
| 6,105,527 | A | 8/2000 | Lochtefeld et al. | |
| 6,167,830 | B1 | 1/2001 | Pilger | |
| 6,234,099 | B1 | 5/2001 | Jessen et al. | |
| 6,332,422 | B1 | 12/2001 | Laroche | |
| 6,415,731 | B2 | 7/2002 | Chrunyk | |
| 6,505,572 | B1 | 1/2003 | Seipel et al. | |
| 6,561,860 | B2 | 5/2003 | Colyvas | |
| 6,579,133 | B1 | 6/2003 | Harris | |
| 6,604,478 | B2 | 8/2003 | Barsumian | |
| 6,652,332 | B1 | 11/2003 | Westhoff | |
| 6,676,462 | B2 | 1/2004 | Yanagihara | |
| 6,796,858 | B2 | 9/2004 | Dusablon et al. | |
| 7,311,570 | B2 * | 12/2007 | Csoke | 440/61 G |
| 2002/0174818 | A1 | 11/2002 | von Wolske | |
| 2003/0100231 | A1 | 5/2003 | Yanagihara | |
| 2003/0148674 | A1 | 8/2003 | Divisi | |
| 2003/0183149 | A1 | 10/2003 | Jessen et al. | |
| 2003/0183150 | A1 | 10/2003 | Eck et al. | |
| 2004/0157509 | A1 | 8/2004 | Willmot | |
| 2004/0175997 | A1 | 9/2004 | Johnson | |
| 2005/0126466 | A1 | 6/2005 | Moore | |
| 2005/0155540 | A1 | 7/2005 | Moore | |
| 2005/0202734 | A1 | 9/2005 | Miller | |
| 2005/0215130 | A1 | 9/2005 | Wilson | |

* cited by examiner

LEVEL TRIM ANGLE

RAISED BOW TRIM ANGLE

LOWERED BOW TRIM ANGLE

ELECTRIC SYSTEM

SYSTEM WITH REVERSING PUMP 735

HYDRAULIC SYSTEM WITH REVERSING VALVE 820

METHODS AND ARRANGEMENTS FOR RAPID TRIM ADJUSTMENT

FIELD OF INVENTION

The present invention is in the field of trimming a watercraft. More particularly, the present invention relates to methods and arrangements to rapidly adjust the trim angle of a watercraft. Many embodiments are adapted to automatically make dynamic adjustments to the trim of a watercraft during acceleration from a stop or idle speeds.

BACKGROUND

Propeller-driven watercrafts are generally available as inboard, outboard, and inboard-outboard. Watercrafts with inboard drives ("inboards") typically have a motor mounted in the watercraft and a fixed-position propeller. Inboards are inherently simpler designs than watercrafts with outboard motor drives ("outboards") and watercrafts with inboard-outboard drives ("IOs"), or stern drives, so they are relatively lower cost and lower maintenance. Outboards have one or more outboard motors mounted typically at the stern of the watercraft. And IOs have stern drives, which locate the motor inside the boat at the stern. The propeller is part of the stern drive unit behind the transom, which connects to the motor through the transom of the watercraft.

During acceleration from a standstill or nearly a standstill, the bow of outboards and IOs rise up so far that acceleration is reduced, speed is more difficult to control, visibility by the driver is reduced, and loose items, including people, may slide backwards. For inboards this problem is less. While current hydraulic systems can adjust positions of trim tabs and stern drives to make minor changes to the trim angle of the watercraft, current systems do not adjust the trim angle, or bow angle, of the watercraft rapidly enough to address the problem of the raised bow during acceleration. This lack of ability for rapid adjustment has led to the dominance of inboards for boats primarily dedicated to pulling skiers.

SUMMARY OF THE INVENTION

The problems identified above are in large part addressed by methods and arrangements to adjust the trim of a watercraft. One embodiment provides a sensor for adjustment of a trim angle of a watercraft in a body of water. The sensor may comprise a joint to couple with the watercraft, having an axis of rotation substantially horizontal and orthogonal to the direction of boat motion; a member coupled with the joint, the member to be in contact with the body of the water, wherein the member (like a weather vane) is to rotate with respect to the axis of the joint in response to a change in the trim angle of the watercraft, based upon a force applied to the member, the force being responsive to a flow of the water contacting the member as the watercraft moves with respect to the body of the water; and a measurement device to couple with the joint, wherein the measurement device is to produce a sensor signal in response to a rotation of the member with respect to the axis of the joint, wherein the sensor signal is indicative of a rotational position.

Another embodiment provides a sensor for adjustment of a trim angle of a watercraft in a body of water. The sensor may comprise a mass to move in response to both acceleration and tilt (bow rise) of the watercraft, wherein movement of the mass is in a direction substantially opposite that of a direction of the acceleration of the watercraft with respect to the body of the water; a member to couple with the mass, having a first position associated with a constant velocity and other positions based upon the movement of the mass in response to the acceleration and tilt, wherein the other positions are indicative of a magnitude of the acceleration and tilt; and a measurement device in contact with the member to generate a sensor signal responsive to the second position.

Another embodiment provides a gyroscope as a sensor of trim angle for adjustment of a trim angle of a watercraft in a body of water.

A further embodiment provides a watercraft capable of rapid adjustment of a trim angle for the watercraft in a body of water. The watercraft may comprise a hull having a motor to propel the watercraft with respect to the body of the water; a trim adjuster having positions, wherein the positions are associated with adjustments for the trim angle of the watercraft; a driver coupled with the trim adjuster to apply a force to the trim adjuster, the application of the force to reorient the trim adjuster into a position of the positions; a sensor having a member to move based upon changes in the trim angle of the watercraft, wherein the sensor outputs a sensor signal related to the movement of the member; and a control arm coupled with the sensor, wherein the control arm is adapted to modify the tilt or bow lift angle at which the sensor detects no bow lift (the zero position) of the sensor to change, wherein modifying the null position of the sensor adjusts the sensor signal that is related to the movement of the member.

Another embodiment provides a method for adjustment of a trim angle for the watercraft in a body of water. The method generally involves sensing changes in the trim angle of the watercraft based upon movement of a sensor member; generating a sensor signal based upon the changes; adjusting a driver output in response to the sensor signal, wherein the adjusting modifies a position of a trim adjuster to adjust the trim angle of the watercraft in relation to the changes; and changing the sensor signal generated in response to the changes based upon movement of a control arm.

One embodiment provides a watercraft capable of rapid adjustment of a trim angle for the watercraft in a body of water. The watercraft may comprise an IO drive with a shaft whose adjustable length adjusts the tilt of the outboard drive unit thus adjusting up or down the angle of the prop wash. Some IO drives use a gear toothed wheel and driver sprocket to adjust the angle of the IO unit.

Another embodiment provides a watercraft comprising a coupling element to adjust the tilt of the prop.

Another embodiment provides a kit for rapid adjustment of a trim angle for a watercraft in a body of water. The kit may comprise an arm having an adjustable length, wherein the adjustable length is based upon a force such as hydraulic fluid applied to the arm; and a set of instructions to couple the arm between a motor and a shaft at a stern of the watercraft to decrease the length of the arm as the stern of the watercraft changes a tilt of a shaft of the IO drive unit or outboard with respect to the hull to adjust an angle of a propeller downward with respect to the hull, wherein the shaft is to extend below a waterline of the body of the water to position the propeller in the body of the water.

Another embodiment provides a method. The method generally involves sensing a change in a trim angle of a watercraft based upon movement of a sensor member; and adjusting a driver output to adjust a trim adjustment mechanism in response to the changes within approximately two seconds, to adjust the trim angle of the watercraft.

One embodiment provides an apparatus. The apparatus may comprise a sensor to detect a change in a trim angle of a watercraft; and a driver to transmit a force from the watercraft to a trim adjuster mechanism to adjust the trim angle based upon a signal from the sensor, within approximately two seconds.

One embodiment provides a system. The system may comprise a hull having a stern; a sensor to detect a change in a trim angle of the hull; and a driver to adjust a trim adjuster mechanism to adjust the trim angle based upon a signal from the sensor, within approximately two seconds.

Another embodiment provides a method. The method generally involves applying a force to hold a propeller substantially parallel with a keel of a watercraft; and angling the propeller thrust at a downward angle with respect to the keel in response to a back pressure, e.g., spring adjusted thrust angle.

One embodiment provides an apparatus. The apparatus may comprise an outboard drive to exert a back pressure on a member in response to rotation of a propeller; wherein the member is coupled between the outboard motor and the watercraft to maintain a propeller at an angle substantially parallel to a keel of the watercraft and responsive to the increased back pressure from rapid acceleration to angle the propeller thrust at a downward angle with respect to the trim angle and vice versa.

One embodiment provides a system. The system may comprise a hull for a watercraft; an outboard drive to exert a pressure toward the hull to provide propulsion of the watercraft; and a member coupled between the outboard motor and the hull to maintain a propeller at an angle substantially parallel to the keel of the watercraft and responsive to the pressure exerted by the member(s) to angle the propeller thrust at a downward angle with respect to the trim angle and vice versa.

BRIEF DESCRIPTION OF THE DRAWINGS

Advantages of the invention will become apparent upon reading the following detailed description and upon reference to the accompanying drawings in which, like references may indicate similar elements.

DETAILED DESCRIPTION OF EMBODIMENTS

Figure 1A:
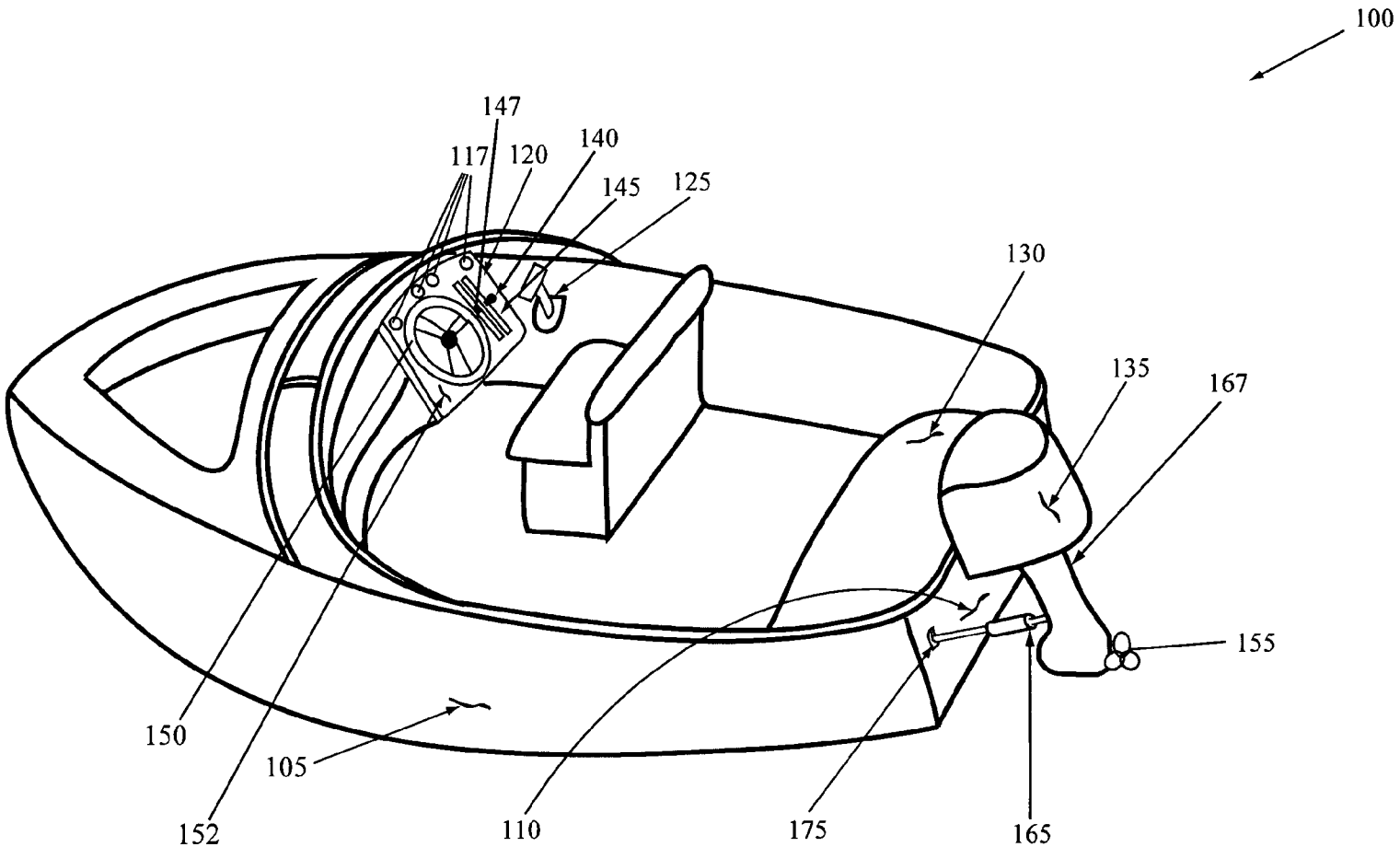
FIG. 1A depicts an embodiment of a watercraft that utilizes a member (165) which adjusts the angle of an outboard motor for rapid trim adjustment.

The following is a detailed description of example embodiments of the invention depicted in the accompanying drawings. The example embodiments are in such detail as to clearly communicate the invention. However, the amount of detail offered is not intended to limit the anticipated variations of embodiments, but on the contrary, the intention is to cover all modifications, equivalents, and alternatives falling within the spirit and scope of the present invention as defined by the appended claims. The detailed descriptions below are designed to make such embodiments obvious to a person of ordinary skill in the art.

Introduction

Generally speaking, methods and arrangements to rapidly adjust the trim of a watercraft are disclosed. More specifically, embodiments comprise a sensor to quickly detect changes in the trim angle of a watercraft and a driver to rapidly change the trim angle of the watercraft via, e.g., changes in the angle of trim tabs or changes in the angle of thrust. For example, many embodiments include large hydraulic pumps or pressurized tanks and large hydraulic connections to rapidly adjust the angle of a trim adjuster such as the angle of trim tabs, an outboard motor, or a stern drive. Some embodiments implement high torque electric motors or high capacity pneumatic systems. The drivers may, for example, effect changes in the angle of the trim adjuster within a few seconds during a ten second acceleration period. In one embodiment, the driver may effect a change in the trim angle within a fraction of a second, depending upon the size of the watercraft, in response to a trim angle magnitude of, e.g., ten degrees. Further embodiments may automatically compensate for trim angles having a magnitude between 15 and 20 degrees.

Embodiments may include sensors such as accelerometers, inclinometers, and speedometers to assess the need for trim adjustment, as well as logic to translate sensor settings and/or defaults. In various embodiments, the sensor may be a pendulum coupled with a device to measure changes in the trim angle, speed, changes in speed, or combinations thereof. Further embodiments may comprise a sensor that contacts the body of moving water to measure the trim angle. Such sensors may measure a true or apparent trim angle depending upon the type and/or location of the sensor. For instance, a sensor in contact with the water below a transom of the watercraft craft may measure an apparent trim angle while a sensor in contact with the body of water at the side of the watercraft may measure the true trim angle. In further embodiments, the sensors may be dampened and/or biased. Advantageously, the cost of such sensors can be less than the cost of, e.g., a gyro-based sensor.

Several embodiments comprise automatic trim angle control. These embodiments may automatically make adjustments in response to acceleration to enhance ride and propulsion efficiency.

While portions of the following detailed discussion describe embodiments of the invention in specific types of watercraft with particular types of drivers, instruments, sensors, control systems, controllers, trim adjusters, and other equipment, embodiments with other watercraft and/or arrangements of equipment to rapidly adjust the trim of a watercraft are also contemplated.

Watercraft and Outboards

Turning now to the drawings, FIG. 1A depicts an embodiment of a watercraft 100, powered by an outboard motor 135. Watercraft 100 comprises a controller 140 adapted to adjust the trim angle, or bow-to-stern angle, of watercraft 100. For example, an operator may adjust the knob of controller 140 to manually adjust the tilt of outboard motor 135 while accelerating or at cruising speed. Alternatively, the operator may shift the knob of controller 140 into an automatic position that engages automatic adjustment of the trim angle of watercraft 100 for rapid adjustment during acceleration and/or adjustment during cruising speeds. The automatic position may respond automatically to trim angles having a magnitude in the range of, e.g., ten to twenty degrees. In some of these embodiments, the operator may set the deviation in trim angle(s) at which controller 140 automatically responds.

Watercraft 100 comprises a hull 105, a steering and instrument panel 120, a throttle control 125, a driver cabinet 130, outboard motor 135, and controller 140. Steering and instrument panel 120 may comprise instruments 117, a steering wheel 118, and possibly other devices. Instruments 117 may provide analog and/or digital indicators linked with sensors such as a tachometer, a speedometer, a pressure gauge for a hydraulic or pneumatic system, a motor temperature gauge, a fuel gauge and/or other sensors that may provide useful information to the boat operator. In some embodiments, controller may provide the digital and/or analog information in place of or in addition to instruments 117.

Throttle control 125 is adapted to adjust the throttle of motor 135, which adjusts the revolutions per minute (RPM) of propeller 155 dependent upon the load imposed by the water. Throttle control 125 may be a mechanical connection, adjusting the throttle via one or more cables, electronic, or other.

Driver cabinet 130 may have a driver such as a hydraulic system, pneumatic system, solenoid, electric motor, or the like, to provide power-assisted steering, rudder control, and throttle control. In some embodiments, control over the position of outboard motor 135 may be power-assisted via the same system. In other embodiments, a separate system may be provided to adjust the position of outboard motor 135. In further embodiments, the hydraulic system may be in a different location such as under the driver's seat or in the motor compartment.

Outboard motor 135 is an outboard motor in the present embodiment and may couple with propeller 155 via a transmission to produce forward, neutral, and reverse propeller rotation.

Watercraft 100 comprises one or more arms 165 coupled with the transom 110 of watercraft 100 between a joint 175 and outboard motor 135 to apply force to outboard motor 135 to adjust or maintain the trim position of outboard motor 135. In the present embodiment, arm 165 is hydraulically adjustable via controller 140. In many embodiments, controller 140 maintains the position of the outboard motor 135 until an adjustment is made manually via controller 140 or, if the knob of controller 140 is in an automatic position, until the trim angle changes sufficiently to instigate adjustment of the angle of outboard motor 135. In several embodiments, controller 140 may change the position of outboard motor 135 in response to certain conditions such as changes in the velocity of watercraft 100.

In further embodiments, controller 140 may maintain the level of watercraft 100 by adjusting the magnitude of components of thrust to dynamically compensate for changes in the port-to-starboard angle in addition to the trim angle of watercraft 100 to stabilize watercraft 100. For instance, watercraft 100 may comprise one or more level sensors to measure the bow-to-stern angle and possibly other angles. Controller 140 may detect changes in the level of boat 100 based upon signals from the sensors and change the angle of outboard motor 135, or at least propeller 155, to direct a component of thrust in a direction determined to compensate for the change in the angle of watercraft 100. In such embodiments, outboard motor 135 or propeller 155 is connected via, e.g., a universal joint, and an arm to facilitate adjustment of the direction of thrust.

Controller 140 comprises an interface for the boat operator to adjust the position of outboard motor 135. In the present embodiment, controller 140 comprises a processor-based controller adapted to adjust the position of outboard motor 135 based upon input from one or more sensors on watercraft 100 when controller 140 is in an automatic mode. Controller 140 also includes a display 147 that displays a position for the knob of controller 140 when the boat operator is adjusting the trim of watercraft 100 manually. The position is determined from the sensor signal that indicates the trim angle of watercraft 100.

Controller 140 may also couple with a sensor (not shown) such as the sensors depicted in FIGS. 5A-B and 6A-D to adjust the tilt of the sensor based upon the trim angle of watercraft 100. Changing the tilt of the sensor may offset the zero or target trim angle reported by the sensor.

Kits

In an alternative embodiment, arm 165 may comprise a spring, piston, strut, or the like and may be adapted to adjust the trim angle of watercraft 100. In particular, since the greatest bow rise occurs during rapid acceleration from slow speed and since this is also the period of greatest thrust, a spring (or pseudo spring achieved through sensor control of powered length adjustment such as a hydraulic or gas powered member), which allows arm 165 to shorten in response to the greatest thrust, has the effect of automatically reducing or eliminating bow rise caused by rapid acceleration from slow speed. The greatest bow rise occurs during maximum acceleration from slow speed and since that is also the time of the greatest thrust and since a spring response (incorporated into arm 165) is in proportion to thrust, bow rise compensation is automatic.

A further embodiment comprises a kit for rapid adjustment of a trim angle for a watercraft in a body of water. The kit may include an arm 165 and a set of instructions. Arm 165 may have an adjustable length based upon a force applied to arm 165. The set of instructions may describe a procedure to couple arm 165 between motor 135 and hull 105 at stern 110 of watercraft 100 to shorten the length of arm 165 in response to the thrust to adjust an angle of propeller thrust 155 downward with respect to hull 110. Shaft 167 is to extend below the waterline of the body of the water to position propeller 155 in the body of the water.

In some embodiments of the kit, arm 165, when installed in accordance with the set of instructions, is adapted to shorten as bow of watercraft 100 rises, to adjust the angle of propeller 155 upward and thrust angle downward with respect to hull 110. Arm 165 may comprise, for instance, a spring, a piston with a compressible gas, a strut, a motorized length adjustable arm, or the like.

Trim Angles

Figure 1B:
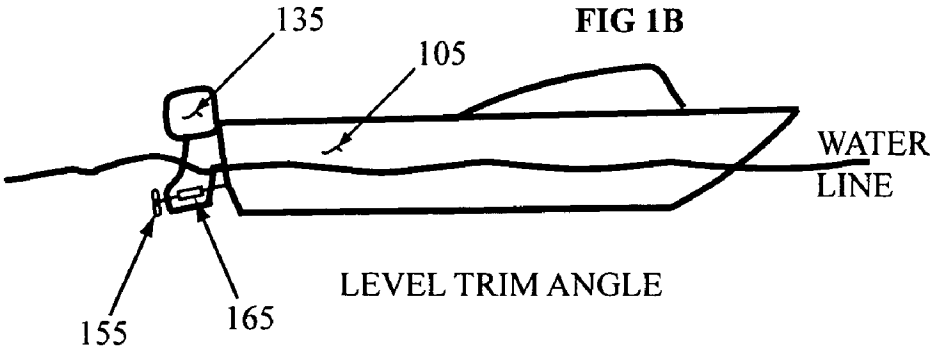
FIGS. 1B-D illustrate various trim angles of a watercraft such as the watercraft in FIG. 1A.
Figure 1C:
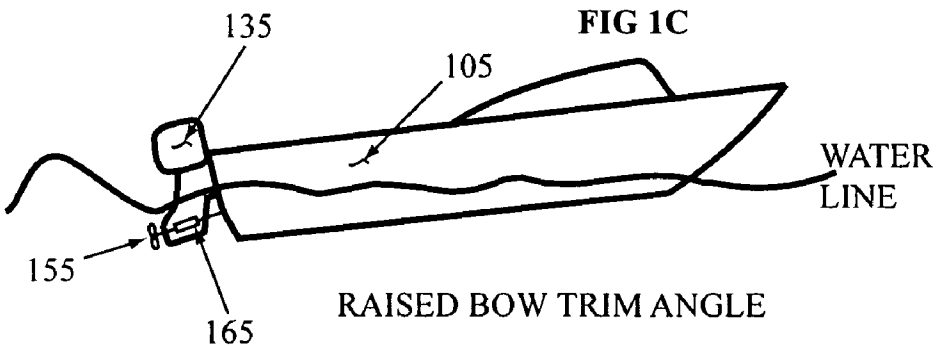
Figure 1D:
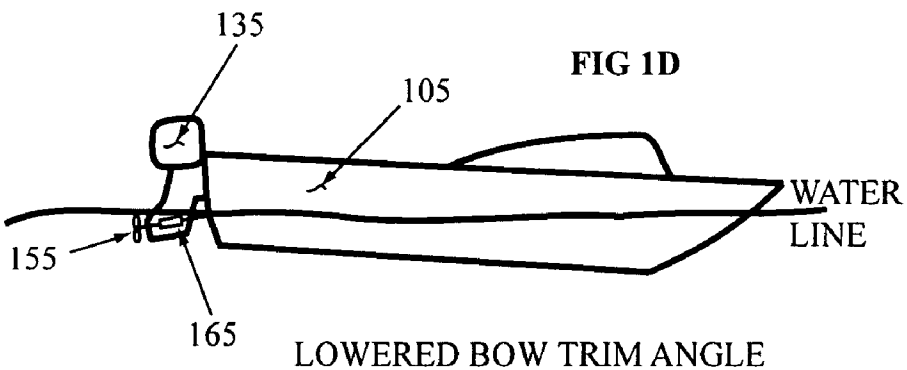

Turning to FIGS. 1B-D, there are shown various trim angles of a watercraft such as the watercraft in FIG. 1A. More specifically, FIG. 1B illustrates the watercraft having a trim angle that is substantially parallel with the waterline. While hull 105 of the watercraft is substantially parallel with the waterline, a trim angle sensor may indicate that the watercraft is substantially level and, thus, the controller may maintain the position of the propeller 155 of outboard motor 135 in its current position via the adjustable arm 165. When the controller is being utilized to manually adjust the trim angle of the watercraft, a display may indicate that no change is recommended to a knob of the controller by showing a graphic element next to the current position of the knob.

FIG. 1C illustrates the watercraft having a raised bow trim angle with respect to the waterline. Notice that hull 105 of the watercraft has a raised bow and lowered stern with respect to the waterline so a trim angle sensor may indicate the negative trim angle. As a result, the controller may determine that the angle of the propeller should be modified in relation to the trim angle. When in an automatic mode, the controller may then adjust the propeller thrust angle downward to raise the stern of hull 105. When in a manual adjustment mode, the controller may comprise a display to indicate an up trim position that compensates for the trim angle by raising the stern.

FIG. 1D illustrates the watercraft having a lowered bow trim angle with respect to the waterline. Notice that hull 105 of the watercraft has a lowered bow and raised stern with respect to the waterline so a trim angle sensor may indicate the positive trim angle. As a result, the controller may determine the angle by which the propeller should be modified in relation to the trim angle to level hull 105. When in an automatic mode, the controller may then adjust the propeller thrust angle upward, which directs thrust upward in this embodiment to lower the stern of hull 105. When in a manual adjustment mode, the controller may comprise a display to indicate a down trim position that compensates for the trim angle by lowering the stern.

Inboards

Figure 2:
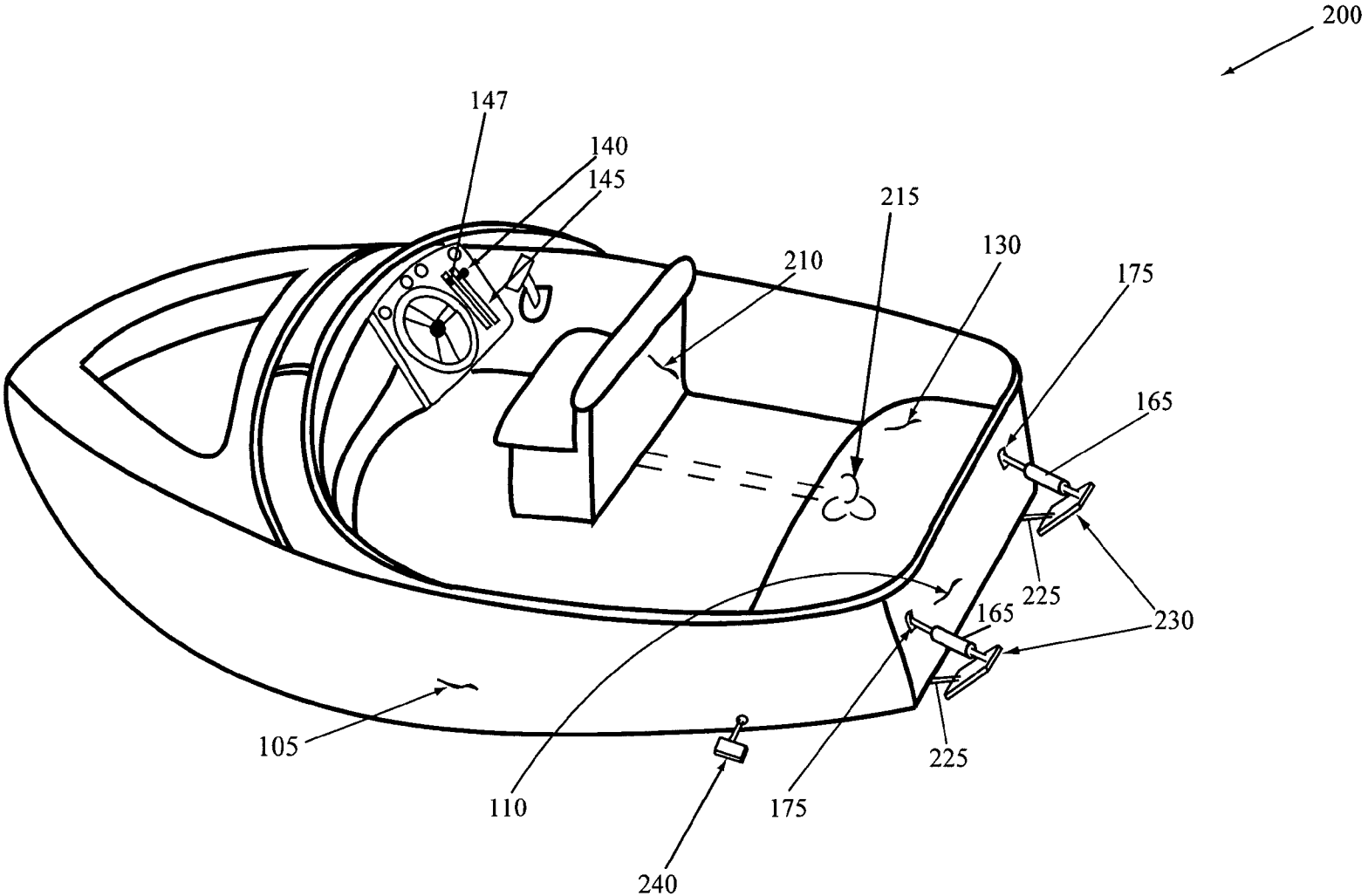
FIG. 2 depicts an embodiment of a watercraft that utilizes trim tabs for rapid trim adjustment.

Referring now to FIG. 2, there is shown an embodiment of a watercraft 200, powered by an inboard motor (not shown). The inboard motor may reside in a cabinet 210 and have a shaft with a propeller 215 that extends below hull 105. Watercraft 200 comprises hull 105, steering and instrument panel 120, driver cabinet 130, controller 140, trim tabs 230, and a trim angle sensor 240. Many of the boat features are substantially the same as watercraft 100 in FIG. 1A so the common features are marked with the same numbers.

Watercraft 200 may enclose a driver such as a hydraulic system, pneumatic system, solenoid, electric motor, or the like, to adjust the positioning of trim tabs 230. For instance, the driver may comprise one or more hydraulic pumps and hydraulic interconnections coupled with adjustable arms 165 to adjust the angle at which trims tabs 230 contact the body of water. In some embodiments, the driver may adjust trim tabs 230 from a position that is substantially level with the waterline of the body of water to a position that receives the water to apply downward force against the transom 110 to lower the stern of the boat down into the body of water. In many embodiments, the driver positions trim tabs 230 in parallel to adjust the trim of watercraft 200. In further embodiments, trim tabs 230 can be operated independently to adjust the port-to-starboard angle of watercraft 200.

Controller 140 comprises an interface for the boat operator to adjust the position of trim tabs 230. In the present embodiment, controller 140 comprises electronics to interpret the signal from sensor 240 and adjust the positions of trim tabs 230 accordingly. Controller 140 comprises an automatic mode and a manual mode. In the automatic mode, controller 140 automatically adjusts the position of trim tabs 230 without further input from the boat operator, based upon input from sensor 240. In manual mode, controller 140 may adjust the position of trim tabs 230 in response to input from the boat operator. In the present embodiment, controller 140 also includes a display 147, which is adapted to inform the boat operator of an adjustment that can be made to the position of trim tabs 230 to level watercraft 200. Controller 140 utilizes the trim angle as indicated by sensor 240 to determine the adjustment for leveling watercraft 200.

Watercraft 200 comprises one or more arms 165 coupled with the transom 110 of watercraft via joints 175. Arms 165 are adapted to adjust the angle of trim tabs 230 with respect to the waterline to raise or lower the stem of watercraft 200. As watercraft 200 moves with respect to the body of water, trim tabs 230 receive a flow of the water and apply the resulting force to transom 110. The angle at which the trim tabs 230 contact the flow of water determines the magnitude of the downward or upward force applied to transom 110. In the present embodiment, arms 165 are hydraulically adjustable via controller 140. In many embodiments, controller 140 maintains the position of trim tabs 230 based upon a signal from sensor 240 if the knob of controller 140 is in an automatic position. When in a manual mode, graphic element 147 may indicate the trim angle based upon the signal from sensor 240 and the boat operator make manually make the adjustments to the position of trim tabs 230 as desired.

Sensor 240 is adapted to provide a signal to controller 140 that is indicative of the trim angle of watercraft 200. In the present embodiment, sensor 240 comprises a plate in contact with the body of water that changes angle with respect to watercraft 200 in response to the force of the water as watercraft 200 moves with respect to the body of water. The magnitude of the change in the angle of the plate determines the signal produced by sensor 240. For instance, the plate may be coupled via an arm to a rheostat that varies in resistance based upon the rotation of the plate. By applying a wattage to the rheostat, controller 140 may generate an electrical wattage related to the trim angle of watercraft 200. If the rheostat is high impedance a voltage output may then be amplified to generate a control signal that drives the driver and/or positions graphic element 147 on a display.

In the present embodiment, sensor 240 is coupled with the starboard side of watercraft 200. Being positioned on the starboard side of watercraft 200, sensor 240 may measure a true trim angle of watercraft 200. In further embodiments, a similar sensor may be positioned on the port side of watercraft 200 and controller 140 may be adapted to account for discrepancies in the signals from the sensors when watercraft 200 is, e.g., turning to port or starboard. In other embodiments, sensor 240 may be positioned behind transom 110 to measure an apparent trim angle of watercraft 200. In other embodiments, sensor 240 may be mounted with a flexible attachment to allow sensor 240 to give-way and optionally go to a position behind the transom when impacted by an object

Inboard-Outboards (IOs)

Figure 3:
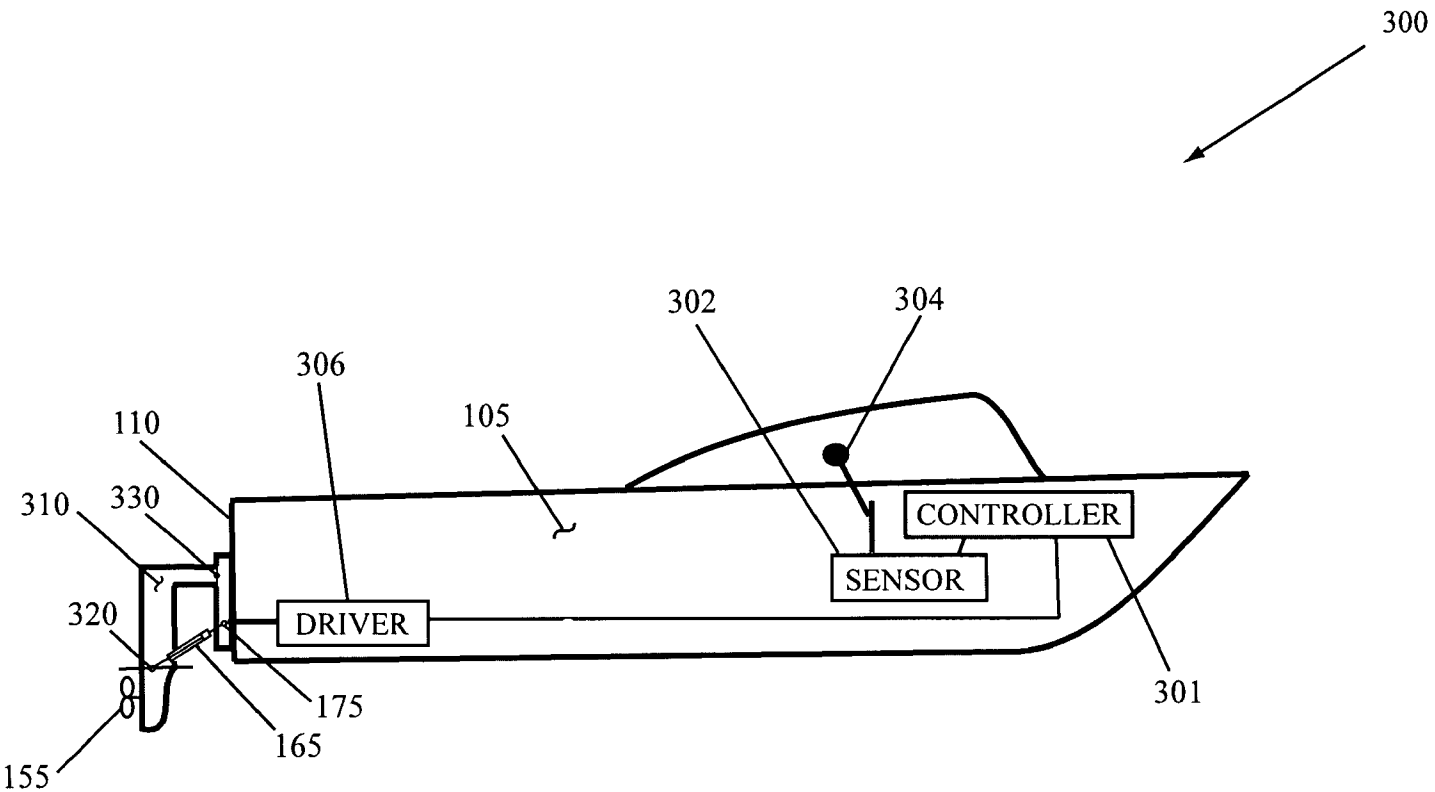
FIG. 3 depicts an embodiment of a watercraft that utilizes a stern drive for rapid trim adjustment.

Turning to FIG. 3, there is shown an embodiment of a watercraft 300 that utilizes a stern drive 310 for rapid trim adjustment such as watercraft 100 of FIG. 1A. Watercraft 300 comprises hull 105, controller 301, a sensor 302, a control arm 304, a driver 306, and stern drive 310. Many of the boat features are substantially the same as watercraft 100 in FIG. 1A and are discussed in sufficient detail above.

Controller 301 comprises an interface for the boat operator to adjust the position of stern drive 310. In the present embodiment, controller 301 comprises electronics to interpret the signal from sensor 302 and adjust the position of stern drive 310 based upon input from sensor 302. The electronics may comprise signal comparators, operational amplifiers, and the like.

Controller 301 comprises an automatic mode. In the automatic mode, controller 140 automatically adjusts the position of stern drive 310 without further input from the boat operator. Controller 301 utilizes the trim angle indicated by sensor 302 to determine the adjustment for leveling watercraft 300. More specifically, controller 301 may translate the signal provided by sensor 302 into a control signal for driver 306 to adjust the position of stern drive 310 to compensate for the trim angle, automatically leveling watercraft 300 during acceleration and at cruising speeds. Controller 301 (or the sensors or motorized actuators in other embodiments) may include an adjustable rate of response to prevent porpoising caused by over correction.

Sensor 302 is adapted to provide a signal to controller 140 that is indicative of the trim angle of watercraft 300. In the present embodiment, sensor 302 comprises a suspended weight as the detector which detects the combined effect of acceleration and bow angle. FIGS. 6A-D illustrate such sensors. At constant speed the weighted arm is vertical and thus provides a reference with which to measure the true bow angle. During acceleration the effect of acceleration will be added to the effect of the bow angle and the sensor will measure the addition of the two effects. Advantageously, sensor 302 may be sealed in a container to protect sensor 302 from ill effects of fresh water and/or saltwater environments. In some embodiments, a liquid to create a response time that is slower than the effects of waves may surround sensor 302. Sensor 302 may also be critically damped via the liquid or other means including electronic signal damping to substantially eliminate transitory over-response.

Control arm 304 is adapted to adjust the tilt of sensor 302 to change the ideal tilt sensed by the sensor 304 when watercraft 300 is accelerating or when watercraft 300 is at a constant trim angle other than level. Control arm 304 may be a manual tilt control in the form of a knob and may be included on or near a steering and instrument panel of watercraft 300. When adjusting the trim angle of watercraft 300, controller 301 may receive an indication of the position of the suspended weight or other tilt indicator such as a gyro sensor and dynamically adjust the tilt of watercraft to place the suspended weight or other tilt indicator back to the center point (ideal tilt). For instance, sensor 302 may comprise a suspended weight that moves in response to changes in the trim angle such that the trim angle is automatically adjusted to bring the weight to the center position. When the desired steady-state trim angle of watercraft is not as desired, control arm 304 may be utilized to adjust the tilt of sensor 304 such that the steady state position of the suspended weight resides in the center or plus/minus zero position. In other embodiments, sensor 302 is designed to have a useable range that encompasses feasible changes in the trim angle so tilting the sensor based upon the trim angle is unnecessary in such embodiments and instead the tilt angle indicated by the sensor is compared with a desired trim angle indicated by the driver. Manual adjustment of trim is, in this embodiment, accomplished by the operator changing the position of a rheostat or other reference signal, which is compared with the trim angle position indicated by the output signal of the control arm 165. In an alternative embodiment, a gyro-based sensor may be utilized in place of the suspended weight.

Driver 306 may couple with adjustable arm 165 to adjust the positioning of stern drive 310. For instance, driver 306 may comprise one or more hydraulic pumps and hydraulic interconnections coupled with adjustable arm 165 to adjust the angle at which propeller 155 of stern drive 310 introduces thrust into the body of water. Driver 306 may add hydraulic fluid to arm 165 in response to a signal from sensor 302 to lengthen arm 165 to angle propeller 155 downward via joints 175 and 330. Alternatively, driver 306 may respond to a control signal from controller 301 to reduce the length of arm 165, angling propeller upward.

Manual/Automatic Controls

Figure 4A:
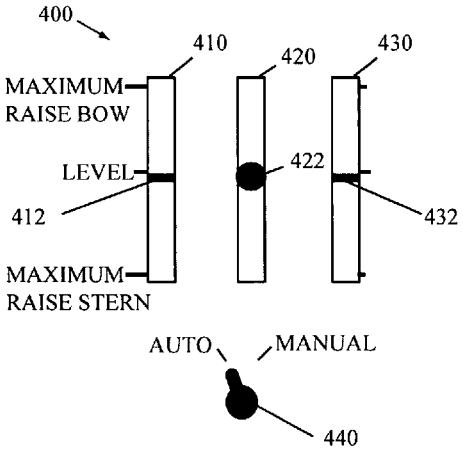
FIGS. 4A-B illustrate manual/automatic trim adjustment controls for rapid trim adjustment of a watercraft such as the watercraft in FIG. 1A.
Figure 4B:
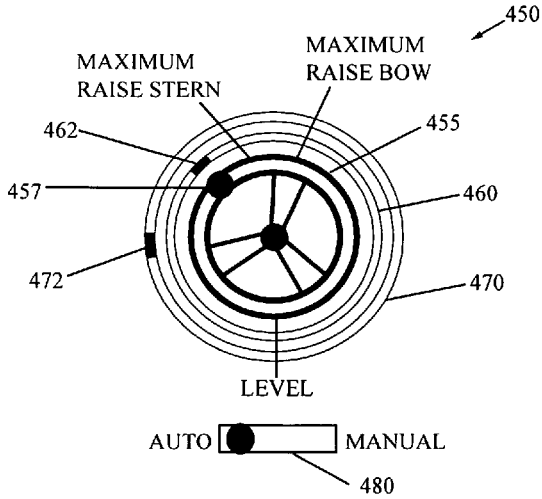
Figure 4C:
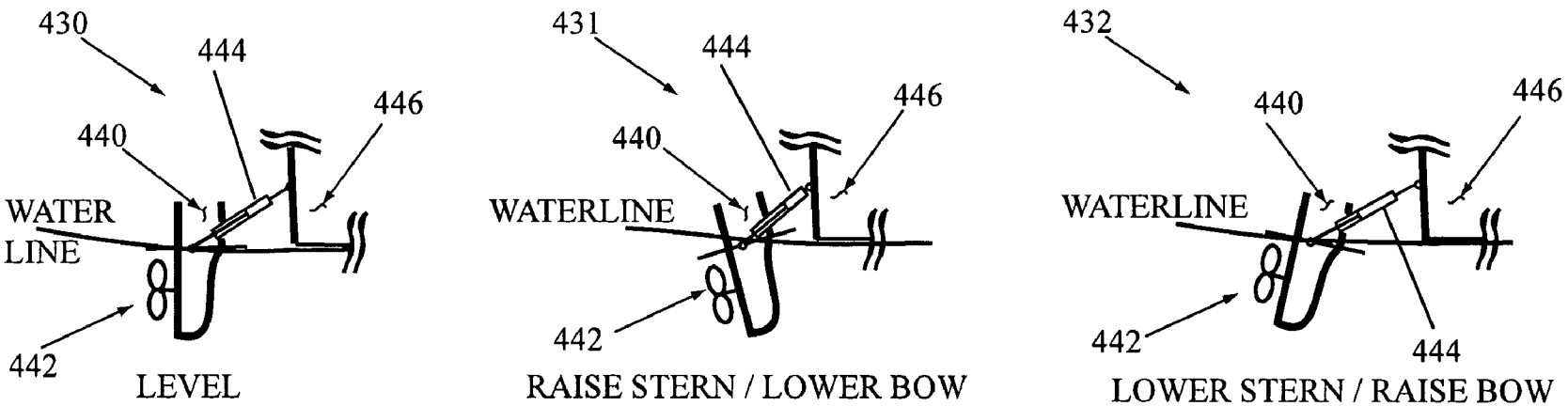
FIGS. 4C-D illustrate example movements of trim adjustment mechanisms to adjust the trim of a watercraft in response to adjustments by the manual/automatic trim adjustment controls illustrated in FIGS. 4A-B.
Figure 4D:
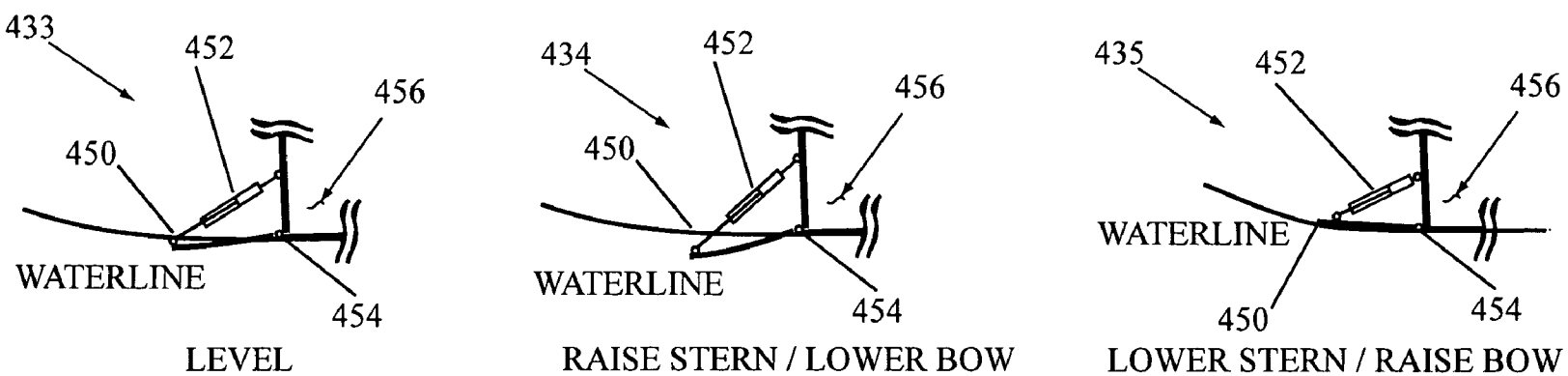

Turning to FIGS. 4A-B, there are shown various configurations of controls that allow for either automatic or manual control of the position of the thrust angle such as trim tab positions which control the trim angle of the watercraft.

Illustration 400 shows an indicator 412 in a column 410 of the trim angle of the watercraft. Indicators 410 and 430 may comprise a dial, a row of lights, a liquid crystal and/or other display suitable for providing visual indication of trim level sensor readings. Multiple displays for sensors in different locations (such as port/starboard) is an alternative configuration.

Illustration 400 shows a knob 422 in the column 420, which is adjustable by the operator of the watercraft from MAXIMUM RAISE STERN to MAXIMUM RAISE BOW position. Column 430 with indicator 432 provides a visual signal to the operator of the actual positions of the propeller thrust angle or trim tab positions. Multiple indicators for multiple propellers or multiple trim tabs is an alternative configuration.

Toggle switch 440 is adapted to change the control of control knob 422 from manual to automatic operation. When switch 440 is in the AUTO position, the trim tabs or propeller thrust is automatically adjusted up or down until 412 is lined up with 422. When switch 440 is in the MANUAL position, the motorized controls are activated to align indicator 432 with 422. This allows the operator to either directly control the position of the trim tabs (or thrust angle) or to have the control logic control the position of the trim tabs (or thrust angle) based on sensor readings.

The controls of illustration 400 may be in duplicate for separate control of port and starboard trim angle, or may be multiple for separate control of multiple trim tabs and propellers, and the controls of illustration 400 may be configured in the shape of a circle as illustration 450 as shown in FIG. 4B. In further embodiments, the controls may be configured in horizontal columns, on a monitor type display, as indicator elements on a joystick, or other configuration suitable for operator control and operator visual perception of trim angle. Various control configurations also optionally offer the operator perception of the position of trim tabs or propeller thrust angle.

Illustration 450 of FIG. 4B shows a wheel 455 with a knob 457 to control the trim of the watercraft between a MAXIMUM RAISE STERN position and a MAXIMUM RAISE BOW position. Toggle switch 480 allows the operator to choose manual adjustment of the thrust angle or automatic adjustment. A ring 460 comprises indicators such as indicator 462 to indicate the actual trim angle of the watercraft according to the sensor(s). And the ring 470 includes indicators such as indicator 472 to describe the angle of the trim tab(s).

In other embodiments, the controller may not include a graphic display. In some of these embodiments, markings next to potential positions for a knob, wheel, or other, may indicate whether to move the trim adjuster upward or downward or otherwise indicate how to adjust the trim angle. In further embodiments, a separate knob, wheel, arm, or the like is included on the watercraft to adjust the tilt of the sensor.

Sensors

Figure 5A:
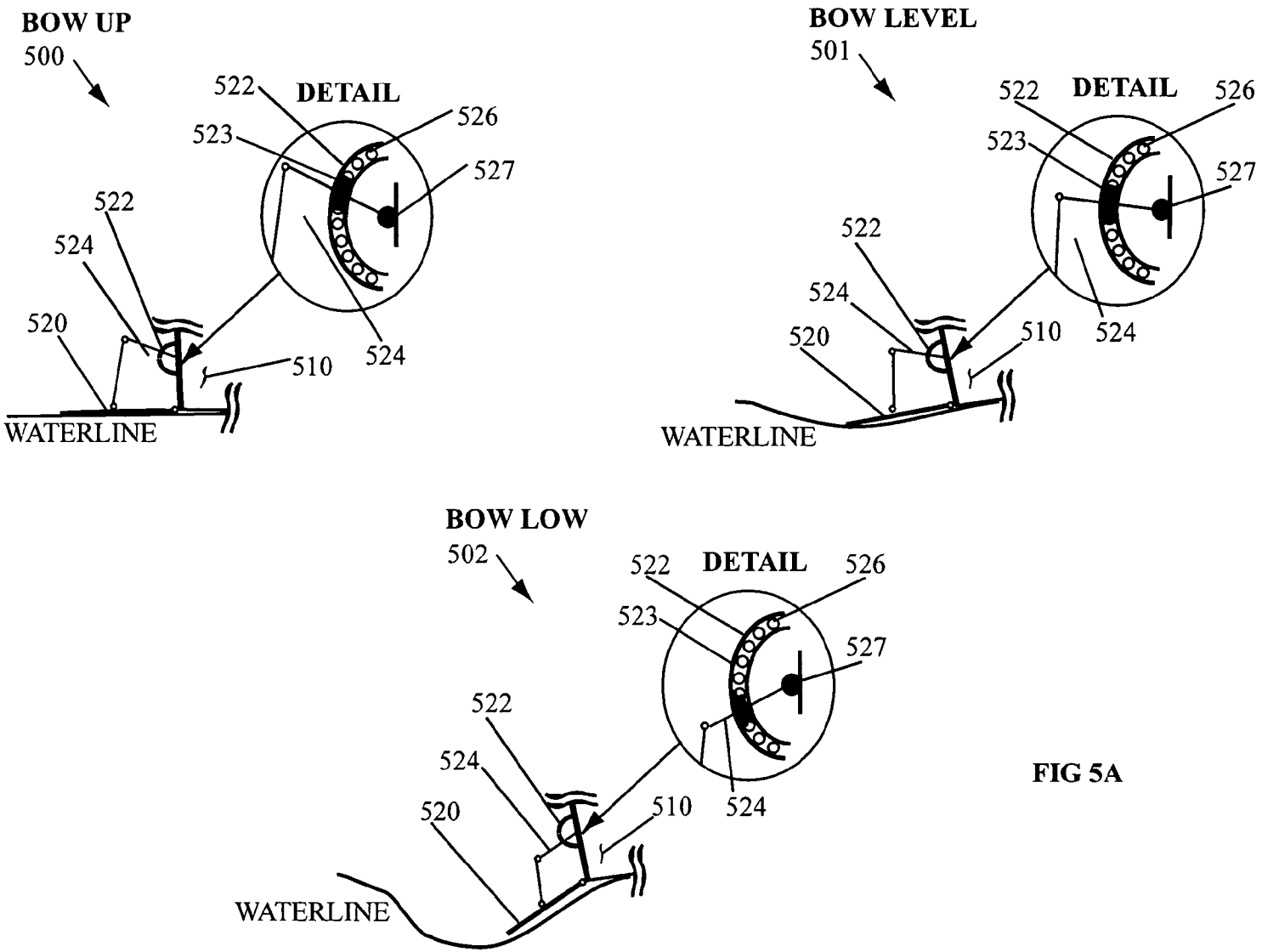
FIGS. 5-6 illustrate embodiments of sensors to detect the true and apparent trim angles of watercrafts.
Figure 5B:
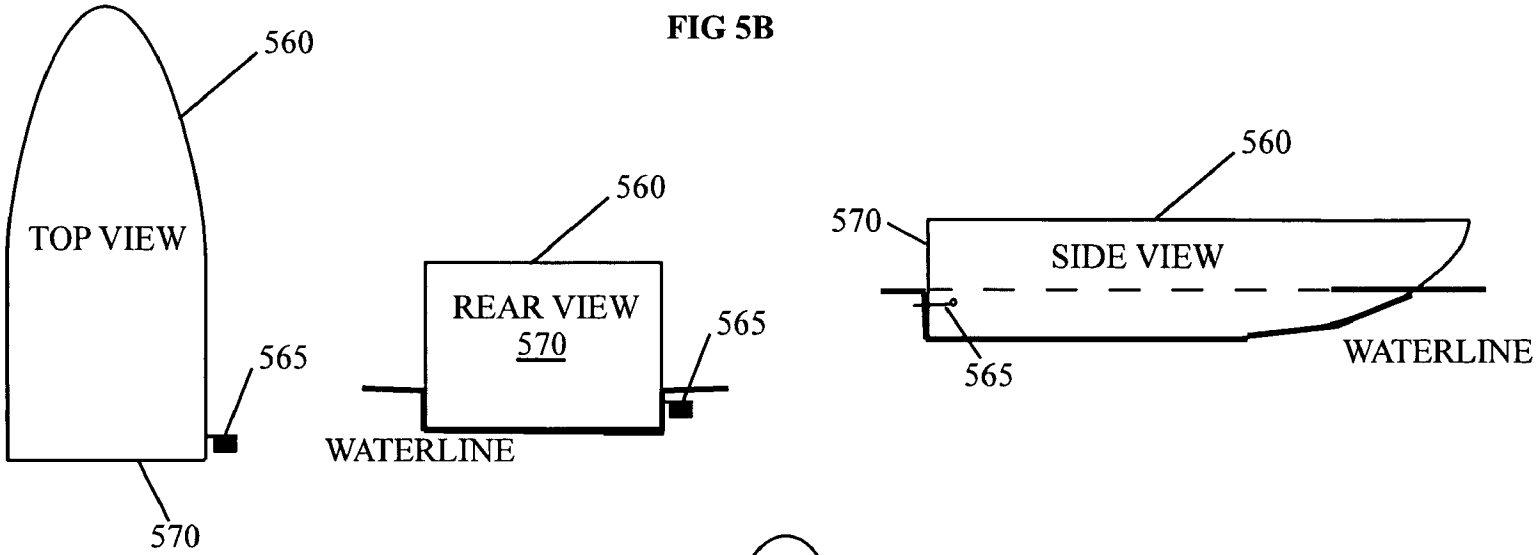

Referring now to FIGS. 5-6, there is shown embodiments of sensors to rapidly detect the true and apparent trim angles of watercrafts. In particular, FIGS. 5A and 5B illustrate different embodiments of a plate sensor that determine a trim angle via contact with the body of water. FIGS. 6A-D illustrate embodiments of a suspended weight or pendulum type sensor that determine the trim angle plus acceleration of a watercraft based upon rotation of the suspended weight; responsive to the additive effects of acceleration and the trim angle of the watercraft.

FIG. 5A depicts embodiments of a plate-based sensor attached to a transom 510 of a watercraft. For the embodiments illustrated in FIG. 5A, the sensor is mounted within the transom width so the sensor measures an apparent bow angle that is a function of speed. The slower the boat speed, the greater the apparent bow angle measured for a given true bow angle. Depending on the amount of speed influence on measured versus actual trim angle desired, embodiments may position the sensor behind transom 510, partially behind transom 510, or fully outside the width of transom 510 as illustrated in FIG. 5B.

Illustration 500 depicts a sensor comprising a plate 520, a measurement device 522, and an arm 524 that couples the measurement device 522 with the plate 520. In this embodiment, the waterline of the body of water is substantially level. Measurement device 522 allows arm 524 to rotate to a position that rests the back end of plate 520 at the waterline and includes contacts illustrated in the detail such as contact 526 to determine the rotation of arm 524 about axis 527. The contacts are positioned along the perimeter of measurement device 522 and a conductor 523 couples with one or more of the contacts depending upon the rotation of arm 524 about axis 527. The contacts coupled with conductor 523 are indicative of the position of plate 520 and, thus, are related to the trim angle of the watercraft.

In some embodiments, the contacts are electrically connected in parallel such that a processor-based controller may determine the trim angle based upon the one or more contacts touching conductor 523. In further embodiments, the contacts may be coupled with resistances and each combination of resistances connected with conductor 523 may be distinguishable by a processor or electronics coupled with the contacts. In other embodiments, measurement device 522 may comprise a rheostat that has a unique resistance associated with each measurable rotation of arm 523 about axis 527. In other embodiments, an off-the-shelf optical sensor may be used to provide a signal which indicates sensor angle or position.

Illustration 501 shows the same sensor as illustration 500 but the waterline is curved as a result of acceleration and a corresponding change in the trim angle of the watercraft. Notice that the rotation of arm 524 about axis 527 has changed as a result of the change in the trim angle. The detail shows that the change in the rotation of arm 524 rotates conductor 523 to couple with a different set of contacts.

Illustration 502 depicts a sensor that is similar to the sensor of illustrations 501 when the waterline is highly curved as a result of strong bow tilt up and there is a corresponding change in the trim angle of the watercraft. Notice that the rotation of arm 524 about axis 527 has changed as a result of the change in the trim angle. The detail shows that the change in the rotation of arm 524 rotates conductor 523 to couple with a different set of contacts.

Figure 5C:
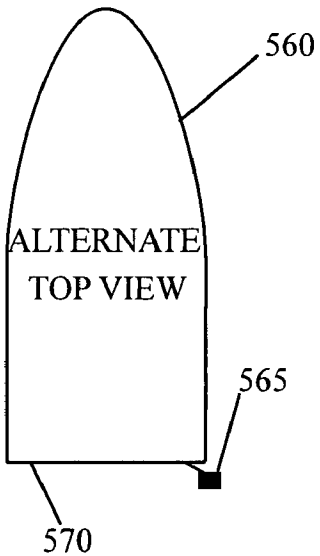

FIG. 5B depicts an embodiment of a plate sensor 565, which is attached outside the width of transom 570 of a watercraft 560. FIG. 5B includes a top view, rear view, and side view of plate sensor 565 to illustrate the positioning with respect to the transom 570 and the waterline. FIG. 5C illustrates an alternative embodiment of a top view of plate sensor 565 that positions plate sensor 565 behind the transom 570.

Figure 6A:
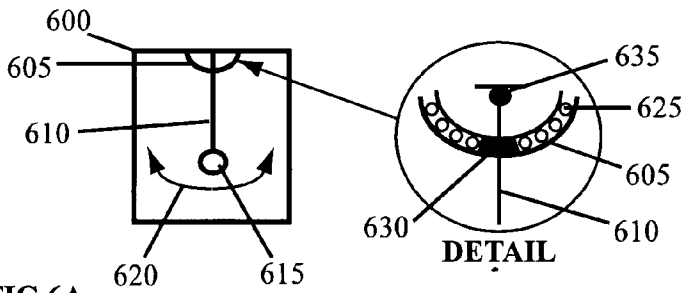

FIGS. 6A-D depict embodiments of a suspended weight or pendulum-type sensor. These sensors 600 employ a measurement device 605 similar to the measurement devices described in conjunction with FIGS. 5A and 5B, which measure a rotation 620 of an arm 610 coupled with the suspended weight or mass 615. In particular, FIG. 6A depicts sensor 600 having an enclosure comprising measurement device 605, arm 610, and mass 615. As a watercraft accelerates and the bow of the watercraft raises, mass 615 swings in a direction opposite the direction of acceleration to reside at an angle that accounts for the effects of the acceleration and the trim angle. As mass 615 swings, arm 610 rotates about axis 635 by an angle related to a combination of the effects of acceleration and the change in trim angle.

Measurement device 605 comprises a conductor 630 that rotates with arm 610 to provide a sensor signal related to the acceleration and the change in the trim angle. A conductor 630 of measurement device 605 rotates along with arm 610 to couple with one or more contacts such as contact 625, which are identified with the rotation. The contacts coupled with conductor 630 provide a means for producing a sensor signal indicative of the trim angle of the watercraft and a controller may then produce a control signal for a driver to adjust a position of a trim adjuster such as a trim tab arrangement to compensate for the change in the trim angle.

In some embodiments, sensor 600 comprises a fluid within the enclosure that dampens movement of mass 615. In many of these embodiments, the fluid is selected or composed to have a viscosity that critically dampens movement of mass 615 or to attenuate or eliminate the effect that waves have on the watercraft. In further embodiments, the trim adjuster may be repositioned in accordance with the sensor signal at time intervals to avoid over correction ("electronic damping").

Figure 6B:
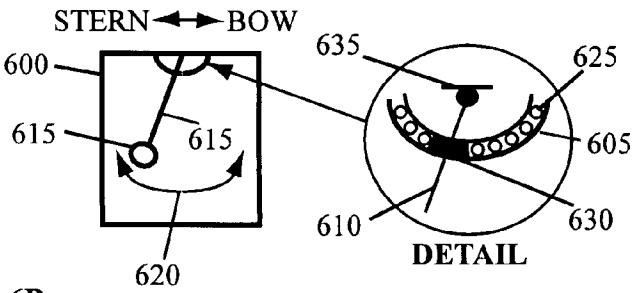
Figure 6C:
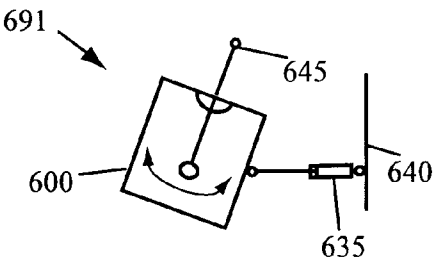
Figure 6D:
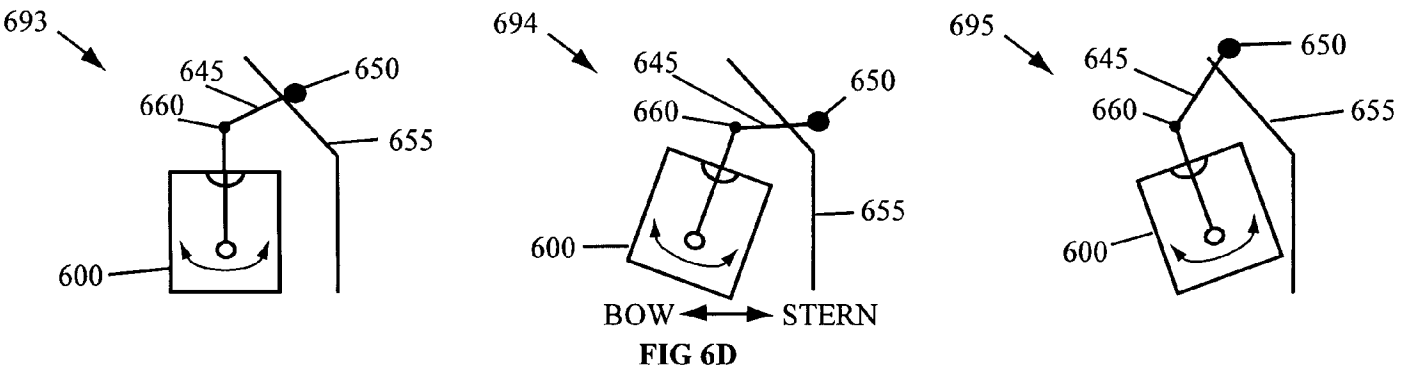

FIG. 6B depicts sensor 600 when the watercraft is accelerating and/or the bow is otherwise high. FIGS. 6C and 6D depict arrangements that allow the controller or a boat operator to adjust the tilt of sensor 600 so that the steady-state rotational position of arm 610 may position conductor 630 at or near the middle of the available contacts of measurement device 605. Thus, changing the angle of boat tilt, which the system tries to maintain, i.e., changing the "set point". Illustrations 690-692 depict an adjustable length arm 635 coupled with a structure 640 of the watercraft. Arm 635 may be lengthened, as shown in illustration 691, to tilt sensor 600 about hinge 645 while the watercraft is accelerating and arm 635 may be shortened, as shown in illustration 692, to tilt sensor 600 about hinge 645 while the watercraft is decelerating. The length of arm 635 may be operator controlled.

Similarly, illustrations 693-695 depict a control arm 645 coupled with, e.g., a steering and instrument panel 655 of the watercraft (bow is to the left in these drawings). Control arm 645 comprises a knob 650 protruding through steering and instrument panel 655 to allow a boat operator to manually adjust the tilt of sensor 600 about hinge 660. Illustration 693 shows knob 650 at a normal or default position. Illustration 694 depicts knob 650 manually moved to a lowered position to lower the bow of the watercraft and illustration 695 shows knob 695 manually moved to a raised position by the operator to raise the bow.

Figure 6E:
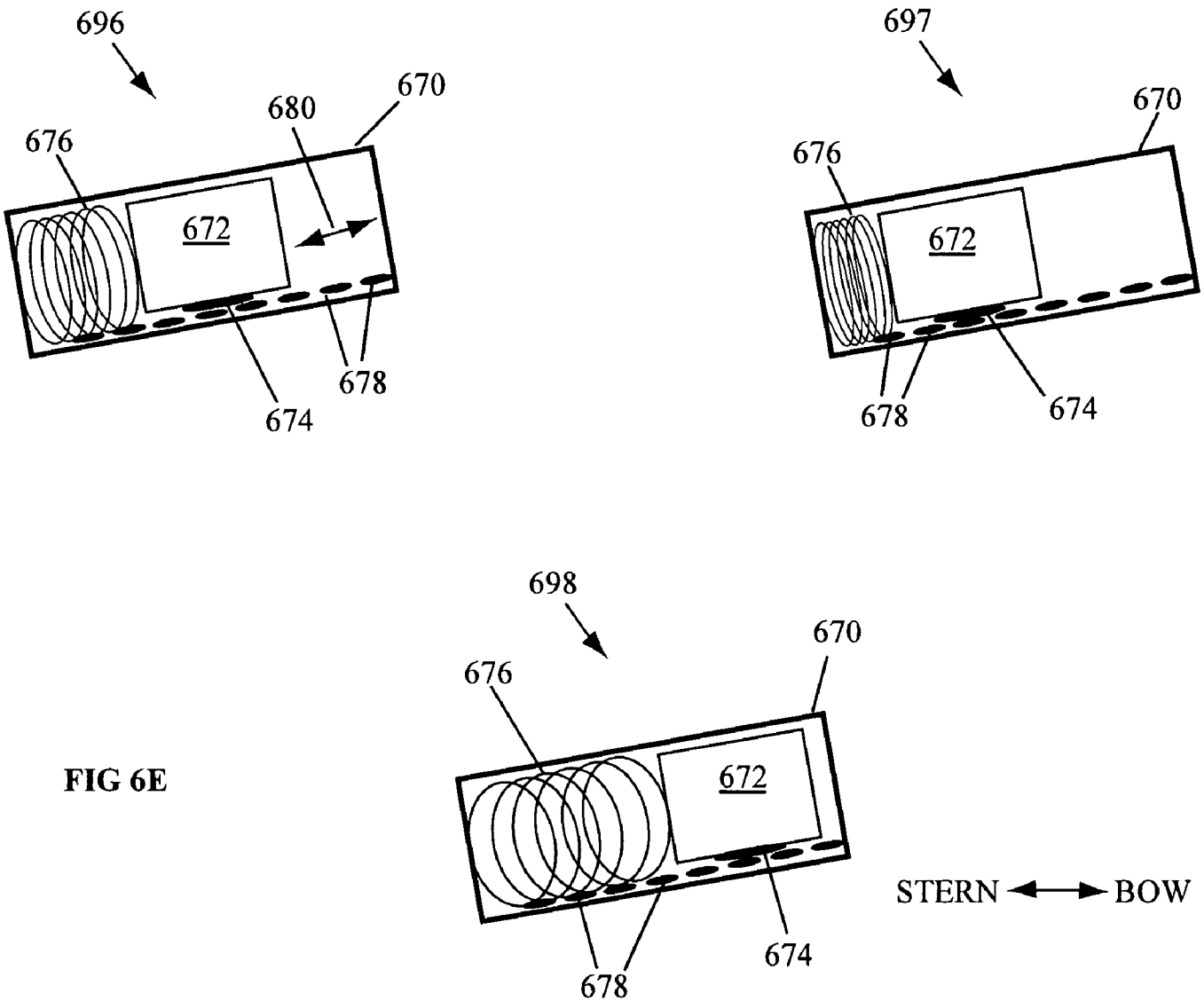

FIG. 6E depicts embodiments of a mass and spring type of sensor (bow is to the right in these drawings). In particular, FIG. 6E depicts sensor 670 having an enclosure comprising a mass 672 having a conductor 674, a spring 676, and contacts 678. Mass 672 is adapted to slide in directions 680 along the length of the enclosure. Illustration 696 shows the steady-state position of mass 674 while the watercraft is at rest. Illustration 697 shows the position of mass 672 as the watercraft accelerates or bow rises. As a watercraft accelerates and the bow of the watercraft raises, mass 672 slides downward, compressing spring 676 and changing contacts coupled with conductor 674 in relation to the effects of the acceleration and the trim angle. In further embodiments, acceleration may stretch the spring 676 or otherwise deflect spring 676 from its rest or steady-state position. On the other hand, as the watercraft decelerates and the bow of the watercraft lowers, as depicted in illustration 698, mass 672 slides upward, stretching spring 676 and changing contacts coupled with conductor 674 in relation to the effects of the acceleration and the trim angle. The contacts coupled with conductor 674 are indicative of the trim angle of the watercraft so a controller may determine the trim angle and produce a driver signal to adjust the trim of the watercraft based upon the contacts coupled with conductor 674. This configuration of sensor 670 may be installed as shown in FIGS. 6C and 6D.

Drivers

Figure 7A:
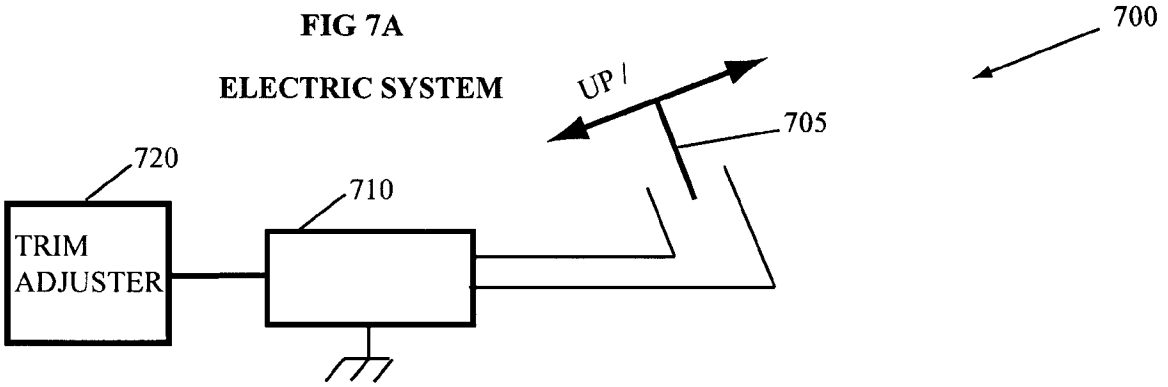
FIGS. 7-8 depict embodiments of electric, pneumatic, and hydraulic drivers, respectively, that are adapted to adjust the trim of a watercraft.
Figure 7B:
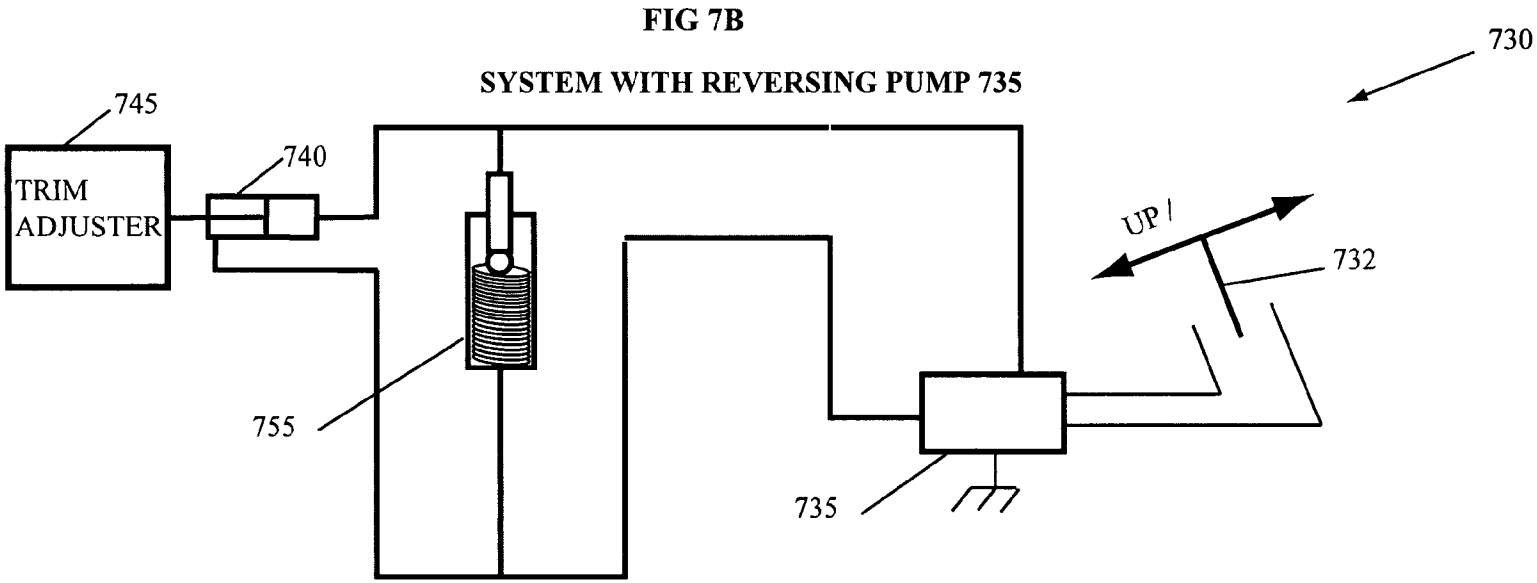
Figure 8:
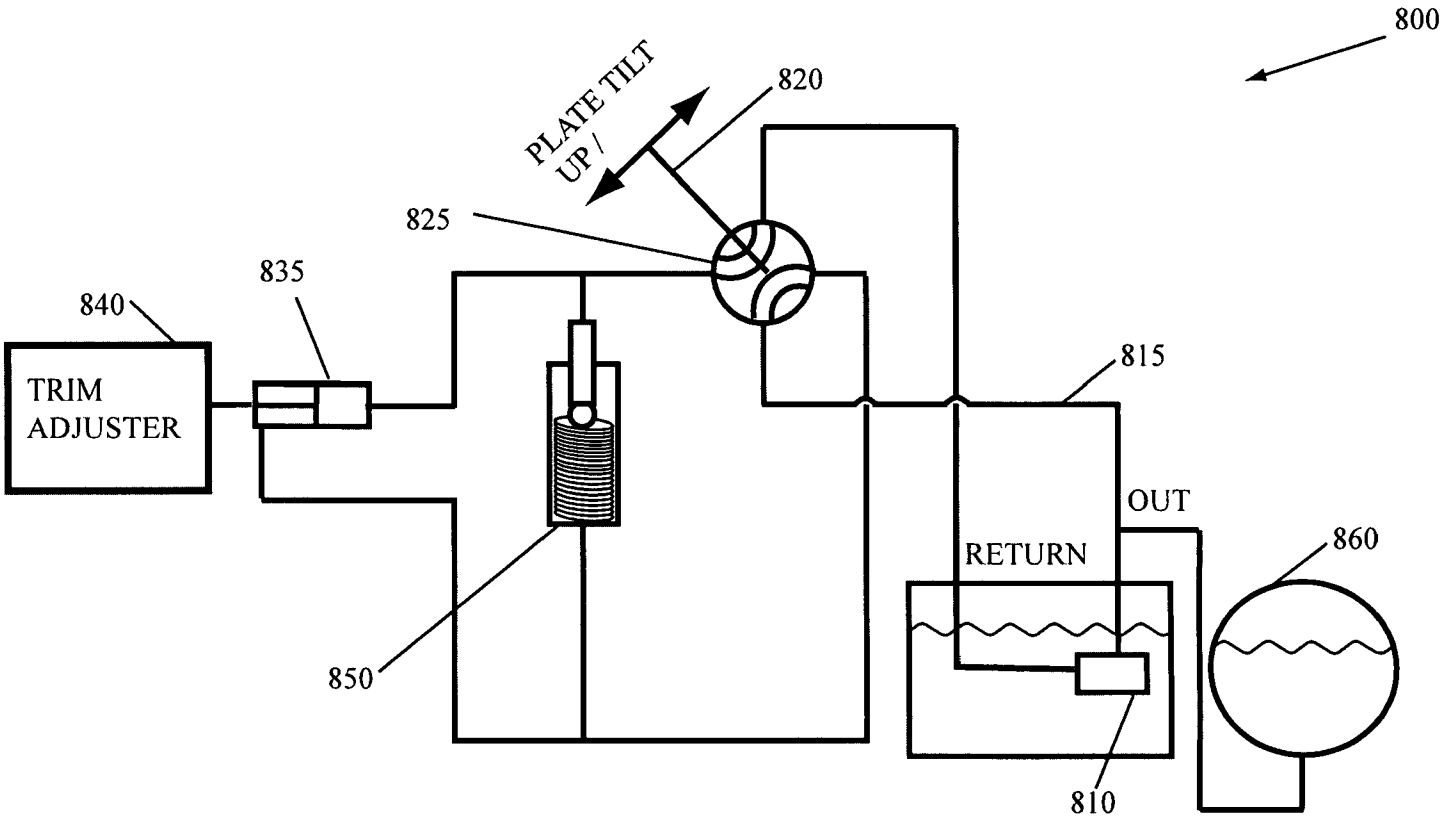

FIGS. 7-8 depict embodiments of electric and hydraulic drivers, respectively, adapted to adjust the position of a trim adjuster. The embodiments depict only one trim adjuster and one control lever to adjust the angle of the trim adjuster up or down for clarity. However, embodiments that control trim tabs may control one or more trim tabs and each system may be adapted to provide adjustment for the angle of each trim tab in one or more different planes by adding more controls as will be obvious to those of ordinary skill in the art based upon this disclosure.

FIGS. 7A-B depict embodiments having a driver comprising electric motors that may run off battery power, an alternator coupled with a gas-powered motor, or the like. The driver is adapted to rapidly change the position of a trim adjuster, such as trim adjuster 720 in FIG. 7A. For instance, a driver may comprise an electric motor coupled with a trim adjuster via an optional reduction gear. The driver may react to input from a control lever or a control signal within three seconds. In fact, in many embodiments, the driver can react to an input within one second and, in some embodiments, the driver reacts within one half of a second.

FIG. 7A depicts an electric system 700 with a direct current (DC) motor 710. The electric motor is advantageously sized to make adjustments to trim adjuster 720 within 2 seconds. In other embodiments, motor 710 may be an alternating current (AC) motor. In several of these embodiments, a DC-to-AC converter may couple with a power system for a boat to power motor 710. For an embodiment such as FIG. 8 comprising hydraulically powered actuators, the non-reversing hydraulic pump may be powered by a mechanical power linkage to a main watercraft propulsion motor such as a belt drive.

A control lever 705, such as a wheel or arm similar to the controllers described in conjunction with FIGS. 4A and 4B, may adjust the magnitude or time of the voltage applied to DC motor 710. For example, applying a positive 12 volts to DC motor 710 may cause DC motor 710 to begin turning trim adjuster 720 upward. Further, applying a negative 12 volts to DC motor 710 may begin turning trim adjuster 720 downward. Many other arrangements for one or more DC motors, solenoids, and/or the like are contemplated. For instance, boats with two trim tabs may comprise separate DC motors to change the position of the trim tabs rapidly.

Trim adjuster 720 may comprise, e.g., one or more trim tabs. In other embodiments, trim adjuster 720 may comprise adjusting the tilt of a stern drive, an outboard motor, the propeller for a stern drive or an outboard motor, or the like.

FIG. 7B depicts an embodiment of a hydraulic system 730 for modifying the position of trim adjuster 745. For example, applying a positive 12 volts to hydraulic pump 735 may cause fluid to flow to cylinder 740. Pump 735 may comprise a reservoir to store hydraulic fluid and the reservoir couples compressor 735 with the remainder of system 730. Increasing the hydraulic flow forces arm 740 to extend to a point related to the increase and then the fluid substantially maintains the position of the arm against forces applied to trim adjuster 745. Extending adjustable arm 740 may adjust trim adjuster 745 in one direction, e.g., upward. If trim adjuster 745 is also spring loaded, the spring will respond to the high force of acceleration without any sensor mediated response.

A relief valve 755 may release hydraulic fluid to reduce the pressure in the system 730 in case of pressure exceeding the pressure at any constant speed which occurs during high acceleration, thus acting like a spring to reduce bow rise during acceleration without any other sensor activation.

FIG. 8 depicts an embodiment of a hydraulic system 830 for modifying the position of trim adjuster 840. System 800 may be designed to adjust the position of a trim adjuster 840 in less than one second via a high-pressure pump 810, large diameter hydraulic interconnections like connection 815, and a pressurized tank 860. In some embodiments, pump 810 may effect changes in pressure rapidly enough to adjust the trim angle during acceleration without pressurized tank 860. In the present embodiment, pump 810 is adapted to pressurize tank 860 by increasing the amount of fluid in tank 860, which pressurizes a gas (e.g. air) in tank 860. Then, pump 810 may pressurize the hydraulic lines via pressurized tank 860 to raise the stern during periods of acceleration. As a result, pump 810 can advantageously build up pressure in tank 860 slowly prior to and during periods of acceleration and then rapidly release the fluid in tank 860 into the hydraulic lines to increase the power of the hydraulic system 800.

The hydraulic system may be designed so that the propeller thrust produces sufficient force in the desired direction that opening a valve on a sufficiently large hydraulic line will move the propeller angle of thrust into the bow lower position without the aid of a hydraulic pump. Thus, in such embodiments, the capacity and pressure of the pump only needs to be sufficiently large to return the propeller assembly to the neutral position. For added speed in returning to the bow neutral position after bow down for acceleration reserve hydraulic power provides greater speed of angle adjustment.

The pressure within system 800 and the position of valve 825 determines the direction in which fluid is applied to arm 830 as well as the magnitude of the pressure. Applying a positive flow of high pressure fluid, when valve 825 is in the position shown, may lengthen an arm 835 and, thus, adjust trim adjuster 840 upward. Twisting control lever 820 may isolate arm 830 from pump 810 to maintain position of trim adjuster 840 via hydraulic fluid in arm 830 at the moment control lever 820 is turned. In some embodiments, when the watercraft is at cruising speeds, changes to the trim angle may be effected less rapidly.

Rotating control lever 820 further may apply the opposite fluid flow to arm 830 and turn trim adjuster 840 downward. A relief valve 850 may allow relief of pressure when the pressure in system 800 rises above a rated pressure. Relief valve 850 is a ball and spring design but other designs are also contemplated. For example, if an object impacts trim adjuster 840, the pressure in system 800 may have a significant spike. Release valve 850 may reduce the pressure in system 800 to avoid damage. In particular, the excess pressure may force a spring to compress, allowing the overall pressure in system 800 to reduce. Many other arrangements are also contemplated. Alternatively, a hydraulic pressure release valve may be installed to allow the added force of rapid acceleration to cause the propeller to go to bow down position as the high pressure is relieved by valve 850. There may be two valves such as valve 850 installed in parallel but in opposite directions: one for automatic bow down during acceleration and one to allow the propeller-drive to raise when an object is struck.

Controller

Figure 9:
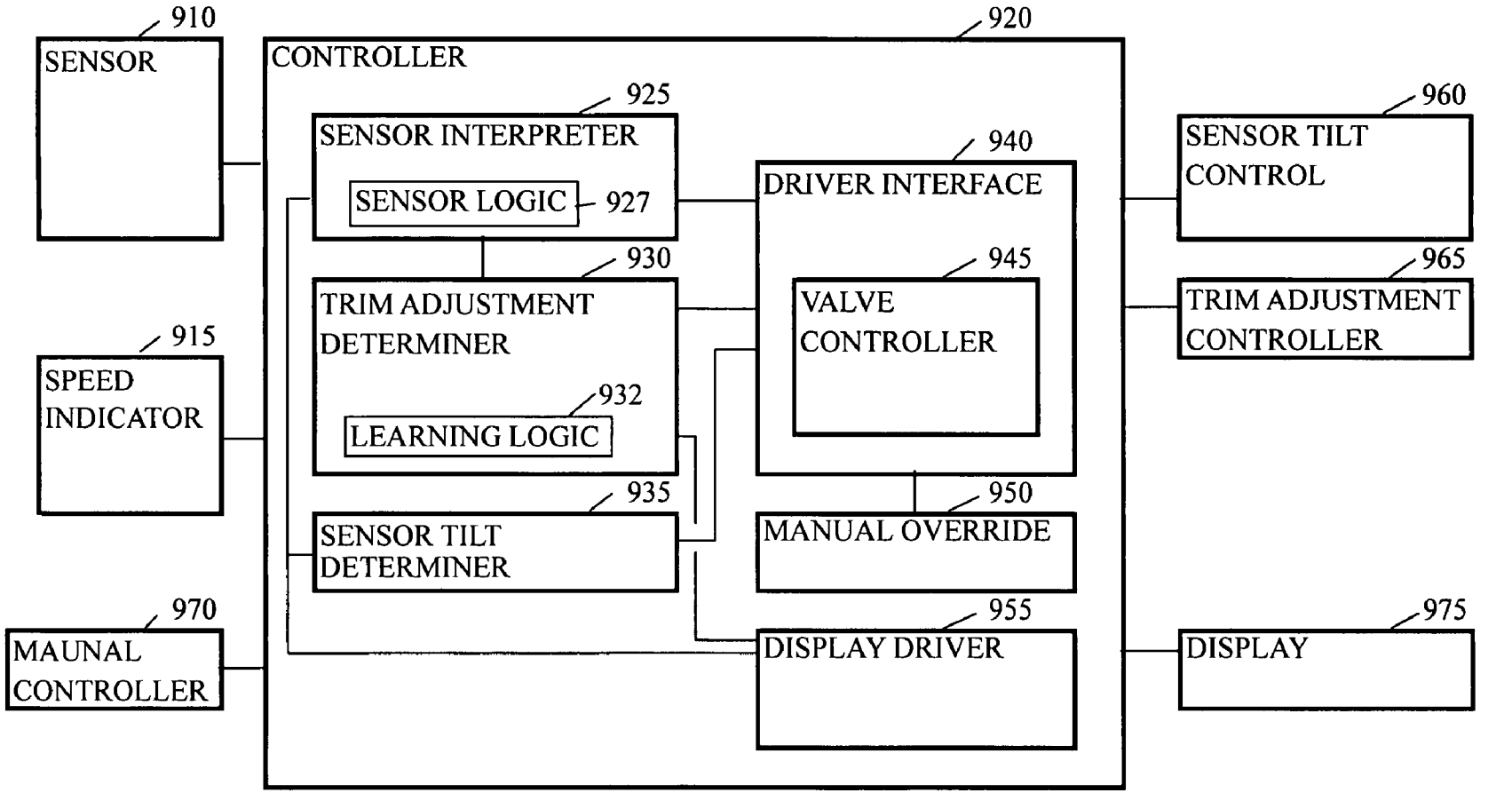
FIG. 9 depicts an embodiment of a control system to automatically adjust the trim of a watercraft.

Referring now to FIG. 9, there is shown an embodiment of a control system 900 to adjust the trim angle of a watercraft based upon a sensor signal. Control system 900 comprises a sensor 910, a speed indicator 915, a controller 920, a sensor tilt control 960, a trim adjustment controller 965, a manual controller 970, and a display 975. Sensor 910 may produce a sensor signal based upon a trim angle of the watercraft and, in some embodiments, acceleration of the watercraft. In several embodiments, sensor 910 provides signal indicative of a true or apparent trim angle. For embodiments in which sensor 910 senses an apparent trim angle, controller 920 may utilize input from speed indicator 915 to modify the sensor signal to be more indicative of the true trim angle.

In some embodiments, sensor 910 includes a sensor to detect when the watercraft is turning such as a sensor on the steering wheel or rudder. In such embodiments, controller 920 may calculate a different ideal, or desirable, trim angle for the watercraft when turning.

Controller 920 may automatically adjust the trim angle of the watercraft in response to changes in the trim angle or provide an interface for a boat operator to manually adjust the trim angle. In some embodiments, controller 920 may couple with a switch that allows the boat operator to switch between an automatic mode and a manual mode via manual override 950 of controller 920.

Controller 920 comprises a sensor interpreter 925, a trim adjustment determiner 930, a sensor tilt determiner 935, a driver interface 940, manual override 950, and a display driver 955. Sensor interpreter 925 may determine the trim angle, or an approximation thereof, based upon the sensor signal from sensor 910. For example, sensor interpreter 925 may apply a voltage to sensor 910 to produce a voltage representative of the trim angle.

In several embodiments, wherein sensor 910 comprise more than one sensors, sensor interpreter 925 may comprise sensor logic 927 to select one or more of the sensor signals by comparing the sensor signals to one another or to a reference, or by determining a combination of the sensor signals. For example, when sensor 910 comprises two plate sensors to measure the trim angle via contact between the plates and the body of water, sensor logic 927 may average the sensor signals when both sensor signals appear to measure approximately the same trim angle. When the watercraft is turning to port or starboard, however, one of the sensors may no longer be in contact with the water and may provide an impossible indication of the trim angle. In such situations, sensor logic 927 may disregard the sensor signal from the sensor that does not appear to be in contact with the water and select the sensor signal for the sensor that does appear to be in contact with the water based upon, e.g., the indication of an impossible trim angle indicated by the respective sensors.

Trim adjustment determiner 930 may determine adjustments to communicate to driver interface 940 via a control signal, based upon the trim angle of the watercraft as determined by sensor interpreter 925. For instance, trim adjustment determiner 930 may track or receive an indication of the position of a trim adjuster and determine an adjustment to that position based upon a change in the trim angle of the watercraft.

In some embodiments, trim adjustment determiner 930 comprises learning logic 935 to monitor the effect of adjustments to the trim adjuster on the trim angle based upon the control signal. Learning logic 932 may then fine tune subsequent control signals responsive to changes in the trim angle based upon the effect to the trim angle of prior control signals. Thus, learning logic 932 can compensate for differences between theoretically calculated changes in the trim angle and actual changes to the trim angle, which may vary for example depending on loaded watercraft weight. Advantageously, learning logic 932 may also compensate for drift (zero offset) of sensors or trim position indicators.

Sensor tilt determiner 935 may determine an angle by which to tilt sensor 910 based upon the trim angle determined by sensor interpreter 925. For instance, if the trim angle shifts, sensor tilt determiner 935 may adjust the tilt of the sensor to take advantage of the full range of movement detectable by a measurement device of sensor 910. Sensor tilt determiner 935 may communicate with driver interface 940 to adjust the tilt of sensor 910 and communicate the change in the tilt of sensor 910 to sensor interpreter 925 so that sensor interpreter 925 may compensate for the tilt in the determination of the trim angle.

Driver interface 940 may couple with sensor tilt control 960 and trim adjustment controller 965 to adjust the tilt of sensor 910 and the position of the trim adjuster, respectively. In particular, driver interface 940 may couple with one or more drivers and/or valves to implement changes to the position of the trim adjuster in response to a control signal from trim adjustment controller 930 and changes to the tilt of sensor 910 based upon an sensor tilt signal from sensor tilt determiner 935. For example, based upon the control signal, driver interface 940 may apply voltage to an electric motor of trim adjustment controller 965 to increase the angle of trim tabs.

In several embodiments, driver interface 940 may comprise a valve controller 945. In such embodiments, driver interface 940 may control the output of a hydraulic or pneumatic pump to implement adjustments to the trim adjuster. For example, in response to a sensor tilt signal from sensor tilt determiner 935, valve controller 945 may adjust the position of a valve to, e.g., increase the hydraulic fluid applied to an adjustable arm coupled with tilt control 960. Increasing the volume of fluid applied to the adjustable arm may lengthen the arm to change the trim angle of watercraft.

Manual override 950 may couple with manual controller 970 to allow a boat operator to manually control adjustments of the trim adjuster and/or the tilt of sensor 910. For instance manual override 950 may be responsive to one or more switches of manual controller 970 to change from an automatic adjustment mode to a manual adjustment mode for the trim adjuster and/or the tilt of sensor 910. In response to communication with manual override 950, driver interface 940 may stop responding to the control signal and/or the sensor tilt signal, and begin responding to an output of manual controller 970.

Display driver 955 may control the output of a display 975 to display, e.g., a graphic element on display 975 that is representative of the trim angle indicated by sensor interpreter 925. In further embodiments, display driver 955 may display an output representative of a position of the trim adjuster.

Flow Charts

Figure 10:
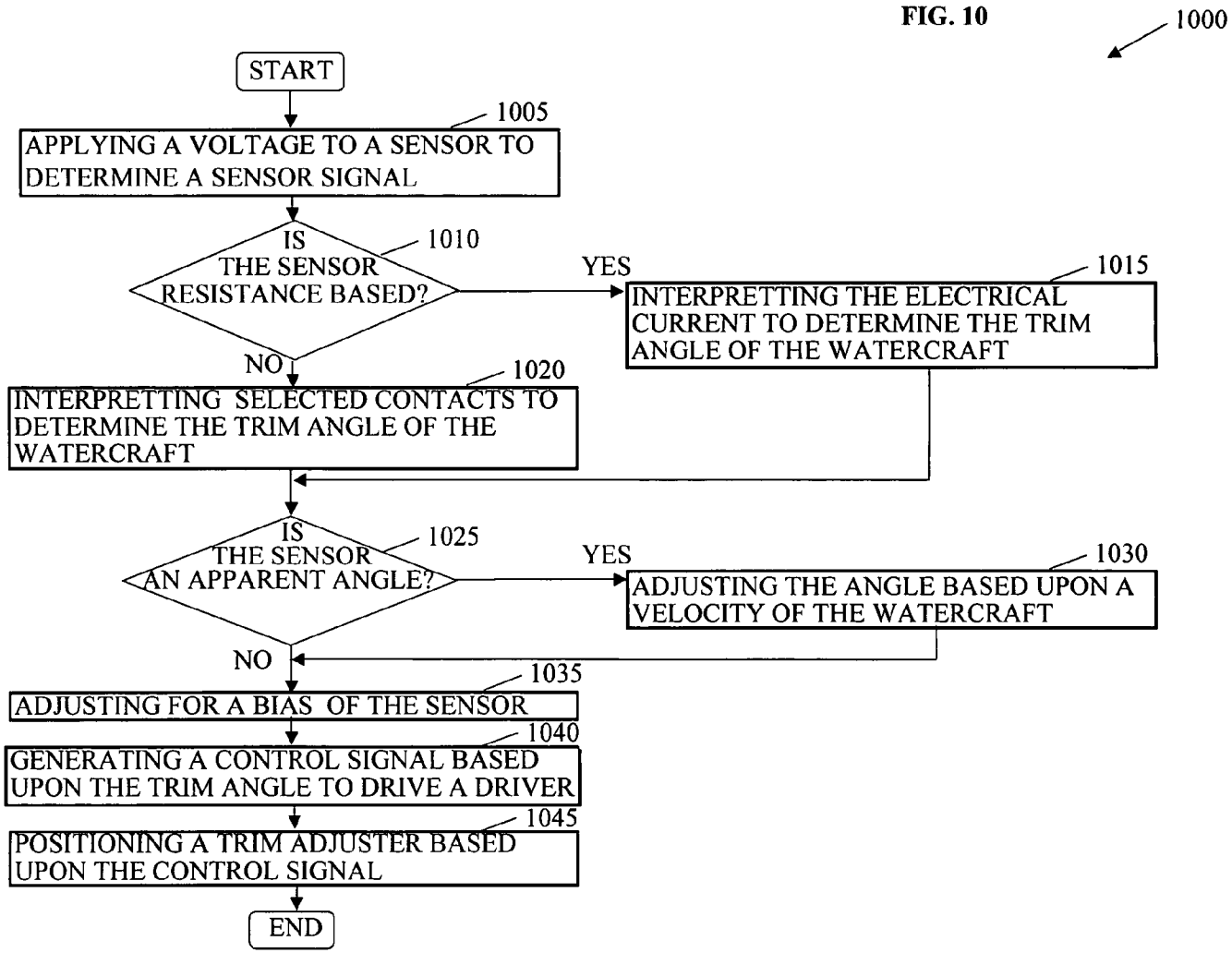
FIG. 10 depicts a flow chart of an embodiment of a system, which is adapted to rapidly adjust the trim of a watercraft.

Referring now to FIG. 10, there is shown a flow chart 1000 of an embodiment for a system, which is adapted to rapidly adjust the trim of a watercraft. Flow chart 1000 illustrates actions of a controller that may be coupled with a watercraft like the controllers discussed in conjunction with FIGS. 1A, 2, and 3. Flow chart 1000 begins with applying a voltage to a sensor to determine a sensor signal (element 1005). For example, the sensor may comprise a rheostat and the resistance ratio of the rheostat segments may be indicative of a trim angle of the watercraft. By applying the voltage, a controller may determine at least an approximation of the trim angle in the form of the ratio of voltages.

When the sensor provides an indication of the trim angle in the form of a resistance (element 1010), the controller may interpret the electrical voltage received in response to applying the voltage to determine the trim angle of the watercraft (element 1015). On the other hand, if the sensor indicates the trim angle based upon, e.g., contacts coupled with a conductor of the sensor (element 1010), the controller may interpret the selected contacts to determine the trim angle of the watercraft (element 1020). For example, the controller may receive the sensor signal via a set of parallel conductors coupled with the sensor. Application of a voltage to the set of conductors may produce a current in two or more of the conductors due to the selection of contacts by the sensor. Depending upon which conductors transmit the current, the controller may determine the trim angle.

If the trim angle indicated by the sensor is an apparent trim angle (element 1025), which may be determined based upon a setting of the controller or a set of contacts at which the controller receives the sensor signal, the controller may calculate an approximation of the true trim angle by adjusting the apparent trim angle based upon the acceleration of the watercraft (element 1030). For instance, the controller may receive an indication of a velocity change or acceleration from, e.g., a speedometer on the watercraft.

Upon determining an approximation of the true trim angle, the controller may adjust the true trim angle based upon a bias of the sensor (element 1035). For instance, if the sensor has been tilted, the controller may compensate for the bias to improve the approximation of the true trim angle. In situations for which no bias is applied to the sensor, no adjustment may be implemented.

With the approximation of the true trim angle, the controller may generate a control signal for a driver to adjust the trim of the watercraft (element 1040). For instance, when the watercraft accelerates, the trim angle of the watercraft may change away from level with respect to the waterline. Upon determining the new trim angle, the controller may adjust the control signal for a driver to level the watercraft. In response to the control signal, the driver may position a trim adjuster, such as a stern drive, to level the watercraft (element 1045). In many embodiments, the controller may automatically trim the watercraft in response to changes in the trim angle from level within five seconds. In some of these embodiments, the controller may effect the trim setting within three seconds. In further embodiments, the controller may change the trim setting in less than one second or even in less than a half of a second.

One embodiment of the invention is implemented as a program product for use with a computer system such as, for example, the controller 900 shown in FIG. 9. The program(s) of the program product defines functions of the embodiments (including the methods described herein) and can be contained on a variety of signal-bearing media. Illustrative signal-bearing media include, but are not limited to: (i) information permanently stored on non-writable storage media (e.g., read-only memory devices within a computer such as CD-ROM disks readable by a CD-ROM drive); (ii) alterable information stored on writable storage media (e.g., hard-disk drive or floppy disks within a diskette drive); and (iii) information conveyed to a computer by a communications medium, such as through a computer or telephone network, including wireless communications. The latter embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, may be part of an operating system or a specific application, component, program, module, object, or sequence of instructions. The computer program of the present invention typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

It will be apparent to those skilled in the art having the benefit of this disclosure that the present invention contemplates rapid adjustment of a trim angle of a watercraft. It is understood that the form of the invention shown and described in the detailed description and the drawings are to be taken merely as examples. It is intended that the following claims be interpreted broadly to embrace all the variations of the example embodiments disclosed.

What is claimed is:

1. A watercraft capable of rapid adjustment of a trim angle for the watercraft in a body of water, the watercraft comprising:

a hull having a motor to accelerate the watercraft with respect to the body of the water;

a trim adjuster having positions, wherein the positions are associated with adjustments for the trim angle of the watercraft;

a driver coupled with the trim adjuster to apply a force to the trim adjuster, the application of the force to reorient the trim adjuster into a position of the positions, wherein the driver is sized to respond to the sensor by repositioning the trim adjuster within five seconds of generation of a sensor signal;

a sensor to output the sensor signal related to the trim angle of the watercraft; and a control arm coupled with the sensor, wherein the control arm is adapted to modify a tilt of the sensor, wherein modifying the tilt of the sensor adjusts the sensor signal that is related to the trim angle.

2. The watercraft of claim 1, further comprising a controller to generate a control signal to instruct the driver to move the trim adjuster based upon the sensor signal.

3. The watercraft of claim 1, wherein the controller is adapted to interpret the sensor signal with respect to a velocity of the watercraft to determine the control signal.

4. The watercraft of claim 2, wherein the controller is adapted to generate the control signal to instruct the driver to move the trim adjuster based upon the sensor signal.

5. The watercraft of claim 1, wherein the trim adjuster comprises an adjustable arm having a length that changes in response to a magnitude of the force of watercraft acceleration.

6. The watercraft of claim 1, wherein the sensor comprises:

a joint to couple with the watercraft, having an axis;

a member coupled with the joint, the member to be in contact with the body of the water, wherein the member is to rotate with respect to the axis of the joint in response to a change of trim angle of the watercraft, based upon a force applied to the member, the force being responsive to a flow of the water contacting the member as the watercraft moves with respect to the body of the water; and a measurement device to couple with the joint, wherein the measurement device is to produce the sensor signal in response to a rotation of the member with respect to the axis of the joint, wherein the sensor signal is indicative of a position of the rotation.

7. The watercraft of claim 1, wherein the sensor is coupled with the hull of the watercraft to measure a true trim angle of the watercraft with respect to the body of the water.

8. The watercraft of claim 1, wherein the driver is sized to respond to the sensor by repositioning the trim adjuster within two seconds of generation of the sensor signal.

9. A watercraft capable of rapid adjustment of a trim angle for the watercraft in a body of water, the watercraft comprising:

a hull having a motor to accelerate the watercraft with respect to the body of the water;

a trim adjuster having positions, wherein the positions are associated with adjustments for the trim angle of the watercraft;

a driver coupled with the trim adjuster to apply a force to the trim adjuster, the application of the force to reorient the trim adjuster into a position of the positions, wherein the driver is sized to respond to the sensor by repositioning the trim adjuster within five seconds of generation of a sensor signal;

a sensor to output the sensor signal related to the trim angle of the watercraft, wherein the sensor comprises:

a joint to couple with the watercraft, having an axis;

a member coupled with the joint, the member to be in contact with the body of the water, wherein the member is to rotate with respect to the axis of the joint in response to a change of trim angle of the watercraft, based upon a force applied to the member, the force being responsive to a flow of the water contacting the member as the watercraft moves with respect to the body of the water; and a measurement device to couple with the joint, wherein the measurement device is to produce the sensor signal in response to a rotation of the member with respect to the axis of the joint, wherein the sensor signal is indicative of a position of the rotation.

10. The watercraft of claim 9, further comprising a controller to generate a control signal to instruct the driver to move the trim adjuster based upon the sensor signal.

11. The watercraft of claim 10, wherein the controller is adapted to interpret the sensor signal with respect to a velocity of the watercraft to determine the control signal.

12. The watercraft of claim 10, wherein the controller is adapted to generate the control signal to instruct the driver to move the trim adjuster based upon the sensor signal.

13. The watercraft of claim 9, wherein the trim adjuster comprises an adjustable arm having a length that changes in response to a magnitude of the force of watercraft acceleration.

* * * * *